US009078508B2

(12) United States Patent
Ramsey et al.

(10) Patent No.: US 9,078,508 B2
(45) Date of Patent: Jul. 14, 2015

(54) DETACHABLE RECEPTACLE

(75) Inventors: Louise Ramsey, Skelmersdale (GB); Peter Ramsey, Skelmersdale (GB)

(73) Assignee: PIN ESSENTIALS LTD, Liverpool (GB)

( * ) Notice: Subject to any disclaimer, the term of this patent is extended or adjusted under 35 U.S.C. 154(b) by 1487 days.

(21) Appl. No.: 12/092,521

(22) PCT Filed: Nov. 6, 2006

(86) PCT No.: PCT/GB2006/004121
§ 371 (c)(1),
(2), (4) Date: Aug. 12, 2008

(87) PCT Pub. No.: WO2007/052051
PCT Pub. Date: May 10, 2007

(65) Prior Publication Data

US 2009/0095781 A1 Apr. 16, 2009

(30) Foreign Application Priority Data

Nov. 4, 2005 (GB) ..... 0522856

(51) Int. Cl.
*A45F 5/00* (2006.01)
*A45C 11/22* (2006.01)
*A45D 33/00* (2006.01)
*A45F 5/02* (2006.01)

(52) U.S. Cl.
CPC . *A45F 5/02* (2013.01); *A45C 11/22* (2013.01); *A45D 33/008* (2013.01); *A45D 2200/051* (2013.01)

(58) Field of Classification Search
CPC ..... A45D 2200/051; A45F 2005/026
USPC ..... 224/196, 269, 271–272, 182, 666, 679; 24/3.1, 3.7, 3.11, 13, 706.3, 706.4, 24/313; 40/661.04, 661.11
See application file for complete search history.

(56) References Cited

U.S. PATENT DOCUMENTS 1,205,546 A * 11/1916 Kendall ..... 132/301
1,486,178 A * 3/1924 Antelmi ..... 224/221
3,430,829 A * 3/1969 Wilson et al. ..... 224/182
3,561,066 A * 2/1971 Osteen ..... 24/3.12
4,961,275 A * 10/1990 Klein ..... 40/1.5

(Continued)

FOREIGN PATENT DOCUMENTS

DE 4219310 A1 12/1992
DE 4238056 A1 5/1994

(Continued)

*Primary Examiner* — J. Gregory Pickett
*Assistant Examiner* — John Cogill
(74) *Attorney, Agent, or Firm* — Defillo & Associates, Inc.; Evelyn A. Defillo

(57) ABSTRACT

A detachable receptacle for carrying material such as cosmetics is disclosed. The receptacle comprises a mounting assembly (12) having fixing means (24 . . . 30) by which it can be secured to a piece of textile material and a container assembly (10). Each of the mounting assembly (12) and the container assembly (10) has mutually co-operative coupling means (26, 56) that permit repeated interconnection and separation of the mounting assembly and the container assembly. Interconnection and separation may be achieved by mutual linear movement. The coupling means may include a first component that has a groove (26) into which a formation (56) of a second component can slide. In preferred embodiments, the container assembly (10) is watertight.

4 Claims, 25 Drawing Sheets

(56) References Cited

U.S. PATENT DOCUMENTS

| | | | | |
|---|---|---|---|---|
| 5,081,709 | A * | 1/1992 | Benyo et al. | 455/348 |
| 5,199,451 | A * | 4/1993 | Montoli | 132/315 |
| 5,379,884 | A | 1/1995 | Bigott | |
| 5,598,926 | A * | 2/1997 | Vogt | 206/457 |
| 5,604,958 | A * | 2/1997 | Anscher | 24/3.1 |
| 5,687,494 | A * | 11/1997 | Laurent | 40/1.6 |
| 5,946,732 | A * | 9/1999 | Richards | 2/247 |
| 5,957,421 | A * | 9/1999 | Barbour | 248/220.21 |
| 6,199,218 | B1 * | 3/2001 | Michael | 2/247 |
| 6,305,591 | B1 * | 10/2001 | Jones | 224/601 |
| 6,425,506 | B1 | 7/2002 | Wu | |
| 6,550,655 | B2 * | 4/2003 | Warner | 224/575 |
| 6,964,361 | B2 * | 11/2005 | Kathrein | 224/183 |
| 7,314,051 | B2 * | 1/2008 | Yuhara et al. | 132/294 |
| 7,912,550 | B2 * | 3/2011 | Scheiner | 607/55 |
| 2005/0060925 | A1 * | 3/2005 | Kaneko et al. | 40/661.04 |
| 2005/0115999 | A1 * | 6/2005 | Johnson | 224/269 |
| 2006/0097019 | A1 * | 5/2006 | Just-Buddy | 224/148.7 |
| 2006/0151355 | A1 * | 7/2006 | Oh | 206/581 |
| 2008/0041899 | A1 * | 2/2008 | Park | 224/271 |

FOREIGN PATENT DOCUMENTS

| | | | |
|---|---|---|---|
| JP | 2002193260 | A | 7/2000 |
| WO | 0115983 | A1 | 3/2001 |

* cited by examiner

DETACHABLE RECEPTACLE

This invention relates to a detachable receptacle. In particular, it relates to a receptacle that can be securely yet detachably carried upon an article of clothing.

There are situations in which people find themselves wanting to carry a receptacle for articles or cosmetic compositions in which they have no convenient pocket and do not wish to carry a bag. For example, people when swimming may wish to carry a supply of sun block composition, but to do so clearly provides practical difficulties resulting from the lack of suitable storage in a typical swimming costume.

Of course, people have made ad hoc solutions to this problem. For example, it will often be possible to attach a suitable receptacle using a safety pin. However, this tends to be fiddly (with the possibility that the receptacle will not be properly attached and lost. Moreover, if the receptacle is repeatedly detached an re-attached, the article of clothing will eventually suffer damage resulting from the repeated puncturing action of the safety pin.

An aim of this invention is to provide means by which a person can carry articles within a receptacle that can be repeatedly dismounted and re-mounted upon an article of clothing in a quick, secure and non-damaging manner.

From a first aspect, this invention provides a detachable receptacle a detachable receptacle comprising a mounting assembly having fixing means by which it can be secured to a piece of textile material and a container assembly, each of the mounting assembly and the container assembly having mutually co-operative coupling means that permit repeated interconnection and separation of the mounting assembly and the container assembly.

Thus, a user can access the container assembly by separating it from the mounting assembly. The latter need not be removed from the article of clothing, thereby minimising the damage done to it.

For example, the mounting assembly may include separable components that can be disposed to clamp textile material between themselves. To achieve a secure connection, one or more of the components may have a formation, such as a pin, that can be passed through the textile material to be retained in another of the components. Retention of the pins may, in preferred embodiments, be by friction. Alternatively, means for producing a positive retention may be provided.

In preferred embodiments, the coupling means may comprise first and second formations that can be interconnected by mutual linear movement. For example, the coupling means may include a first component that has a groove into which a formation of a second component can slide. The coupling means may include retaining formations that interact to resist separation of the first and second formations. (Clearly, alternative connection configurations are possible.)

The container assembly is typically adapted for use with specific contents. For example, it may be a compact that contains a cosmetic preparation. The container assembly is advantageously watertight or water resistant when closed.

Further preferred but non-essential features are set forth in the dependent claims.

From a second aspect, this invention provides a set for providing a detachable receptacle comprising a plurality of mounting assemblies each having fixing means by which it can be secured to a piece of textile material and a container assembly, each of the mounting assemblies and the container assembly having mutually co-operative coupling means that permit repeated interconnection and separation of the mounting assembly and the container assembly; in which the mounting assemblies each have functionally different fixing means and functional similar coupling means.

This allows a user to use their receptacle in a large variety of garments by selection of a suitable mounting assembly.

An embodiment of the invention will now be described in detail, by way of example, and with reference to the accompanying drawings, in which.

Figure 16A:
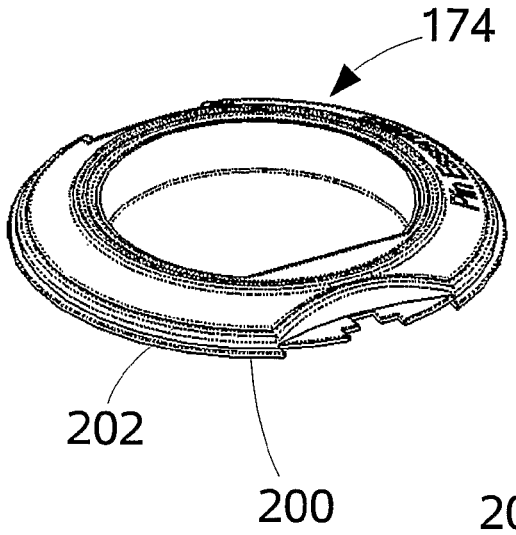
Figure 16B:
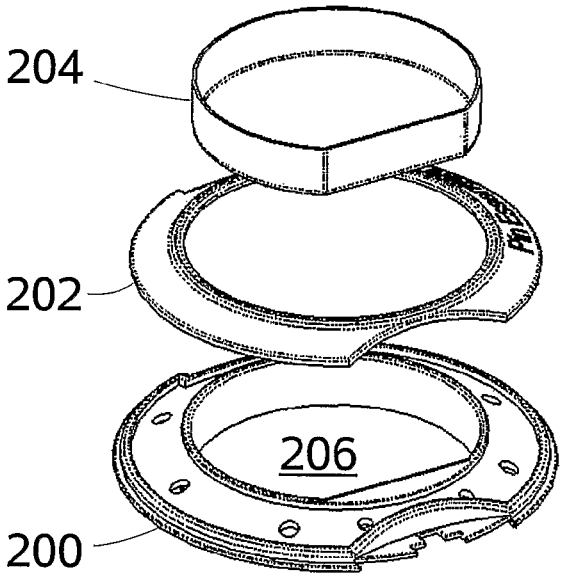
Figure 16C:
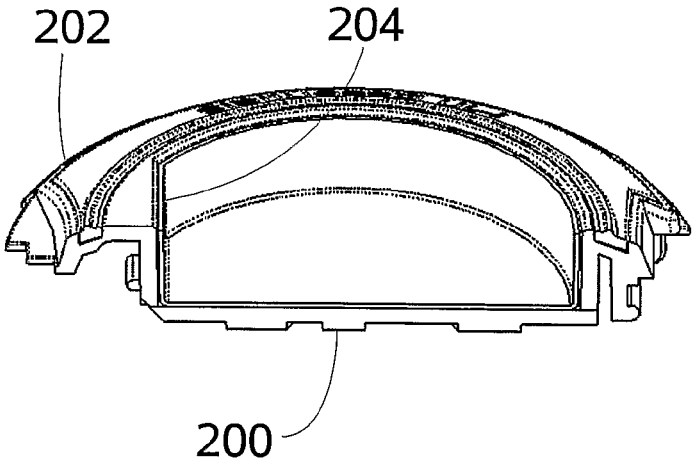
Figure 17A:
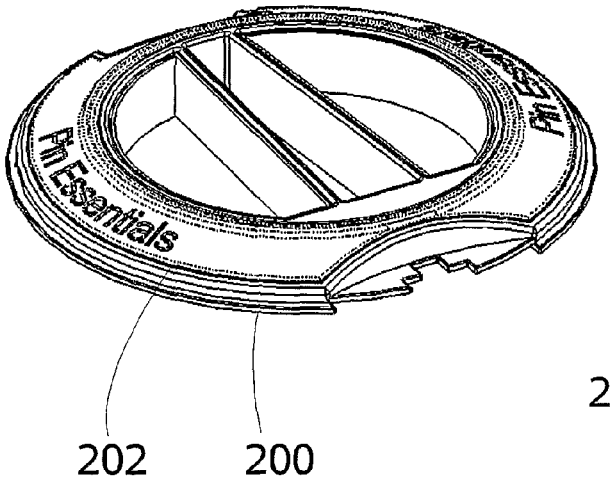
Figure 17B:
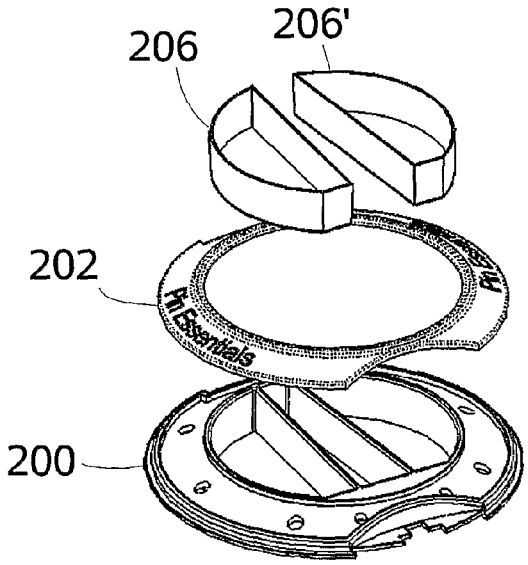
Figure 17C:
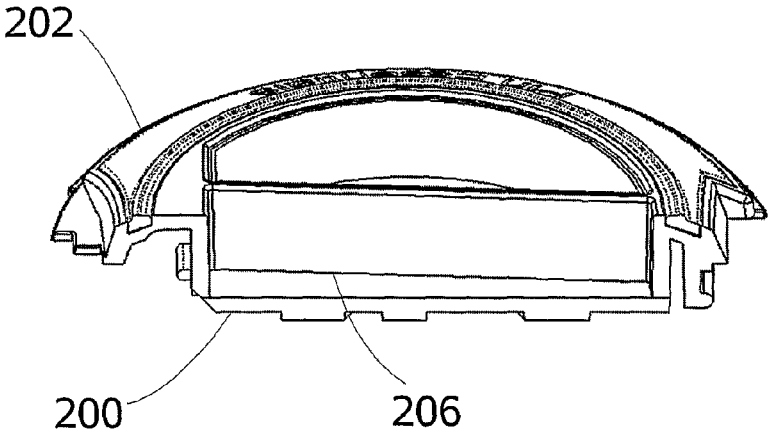
Figure 18:
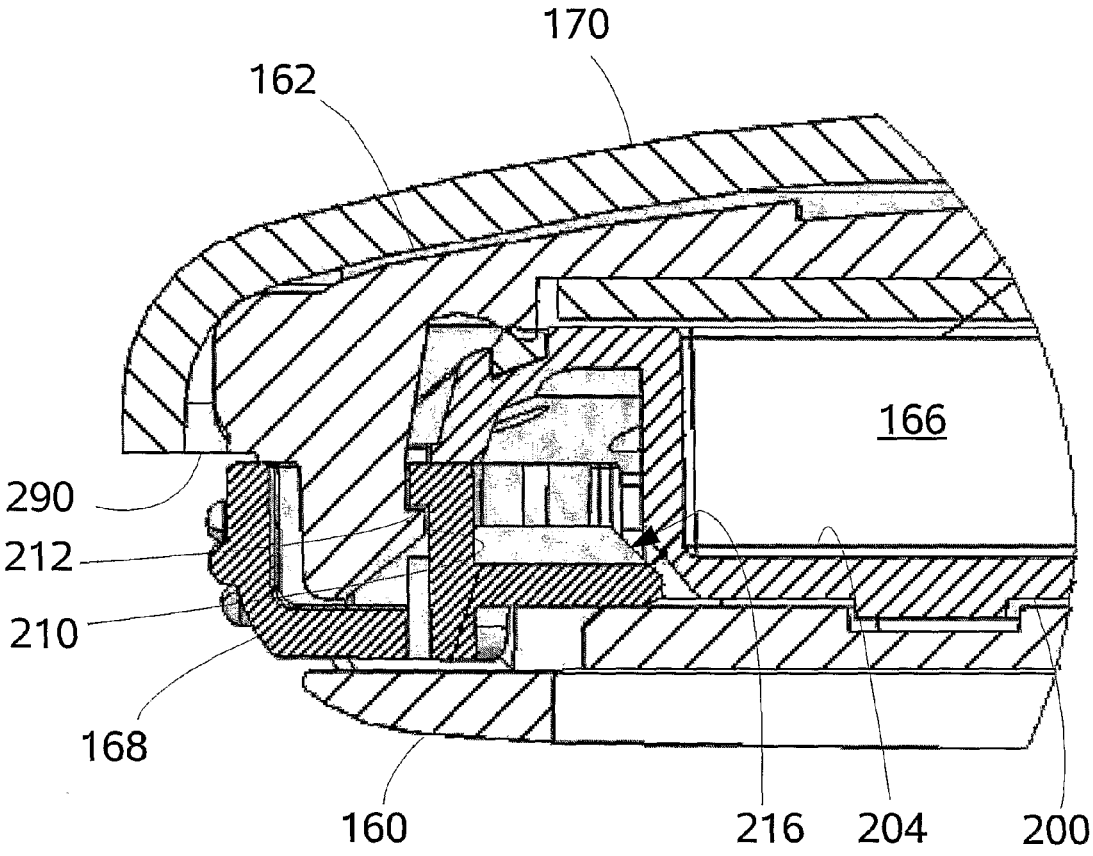
Figure 19:
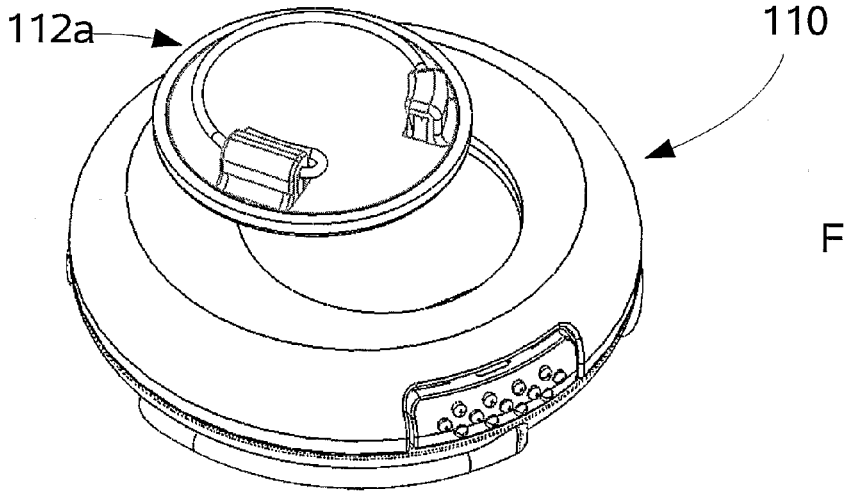
Figure 20A:
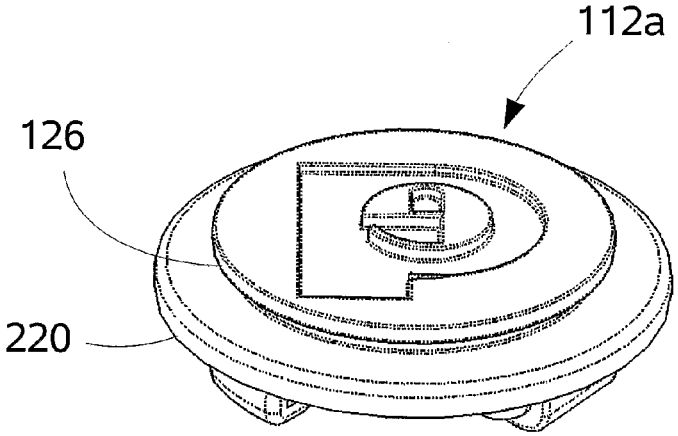
Figure 20B:
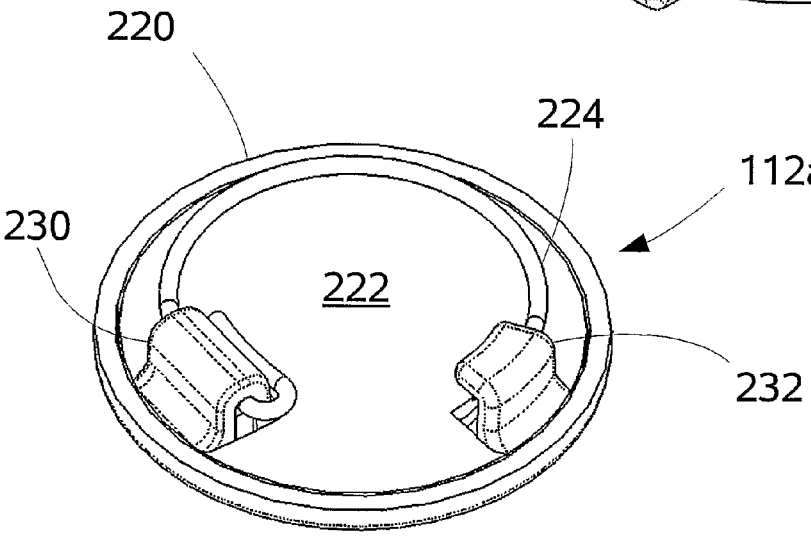
Figure 20C:
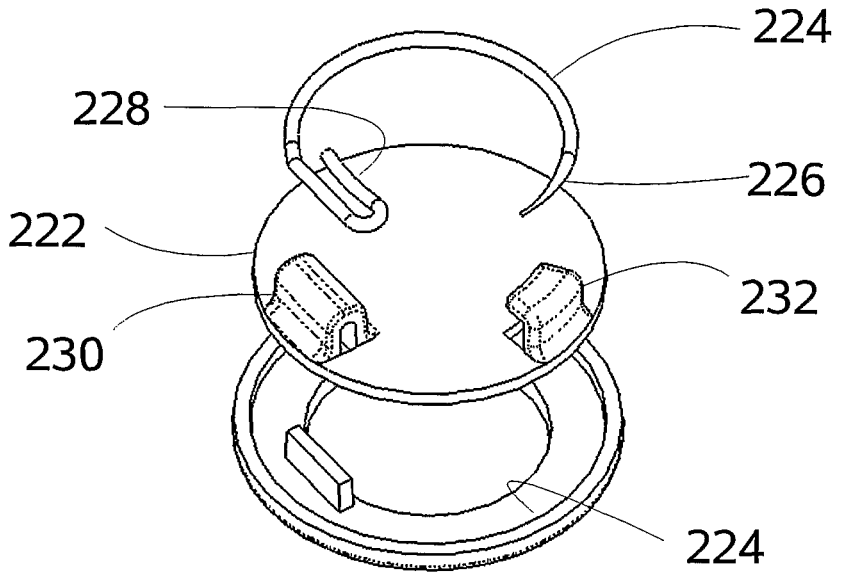
Figure 20D:
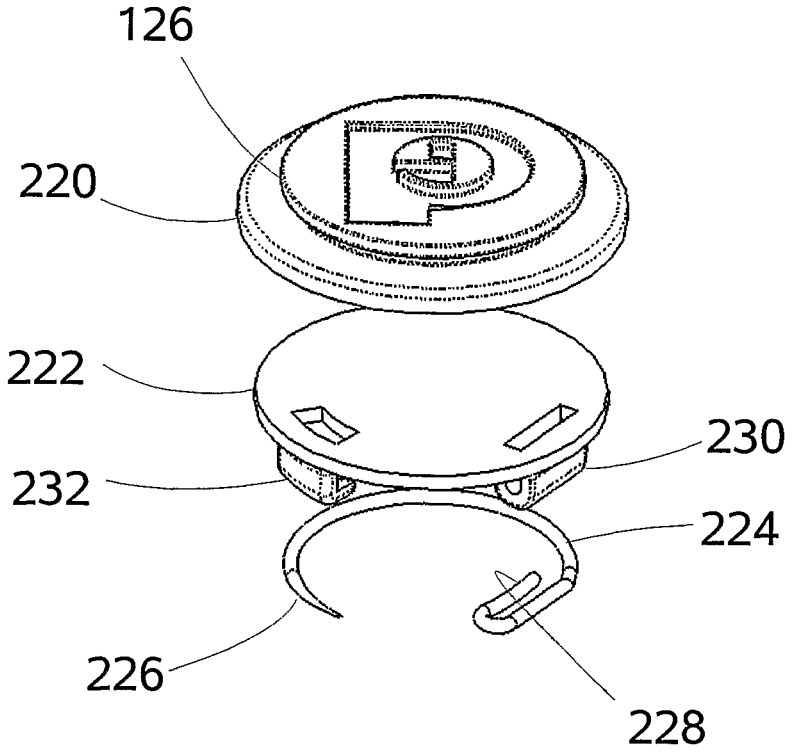
Figure 21:
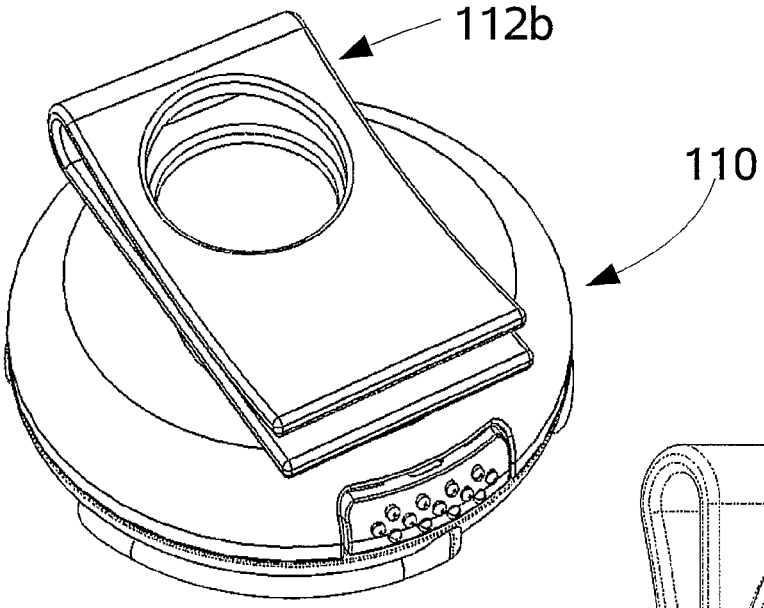
Figure 22A:
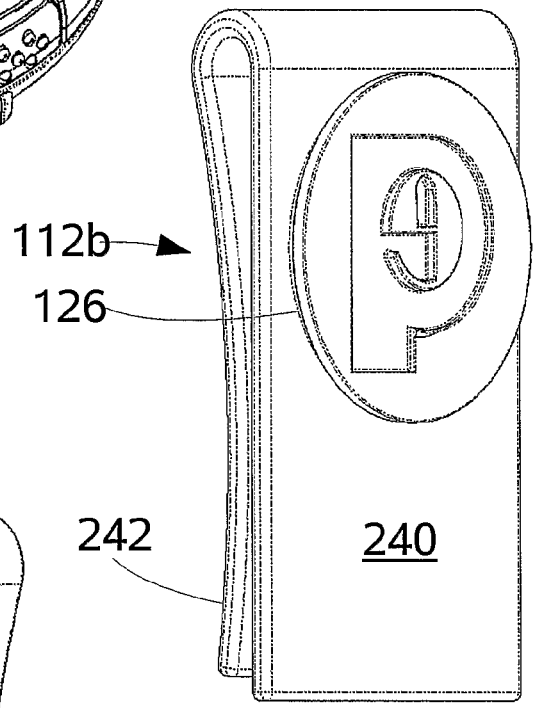
Figure 22B:
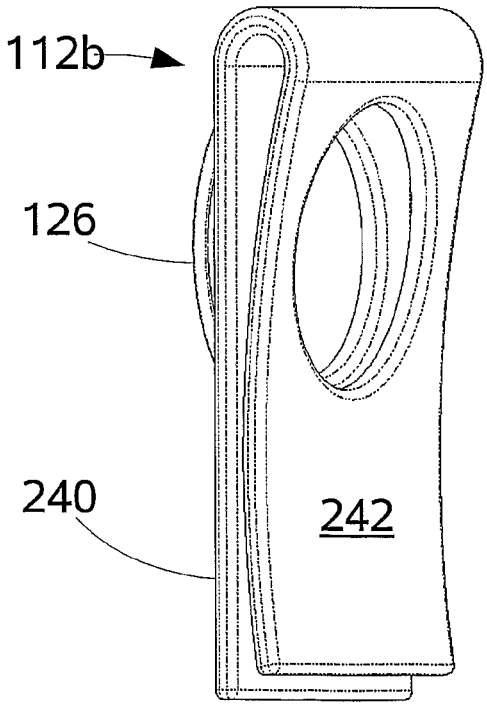
Figure 23:
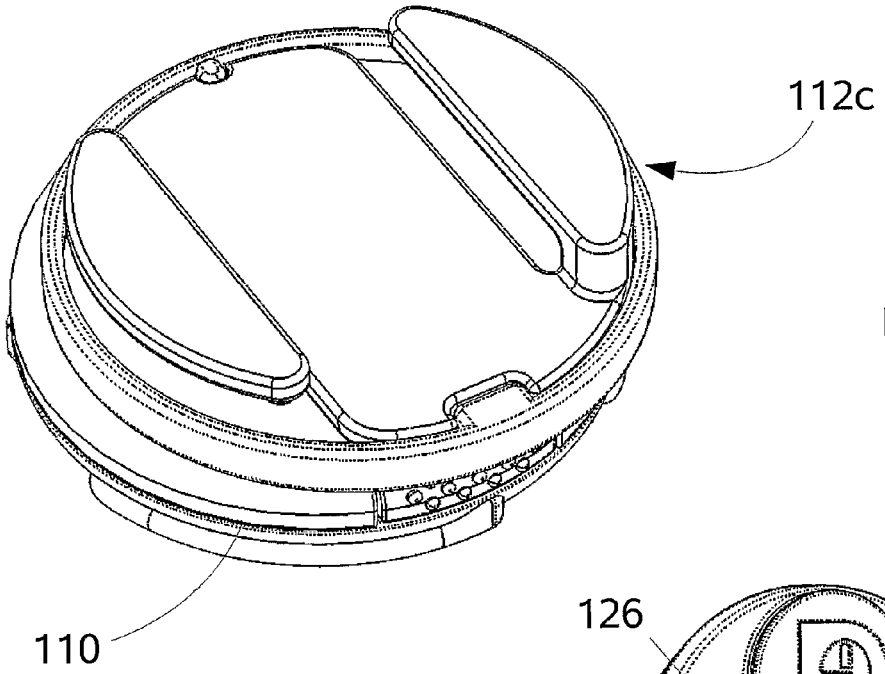
Figure 24A:
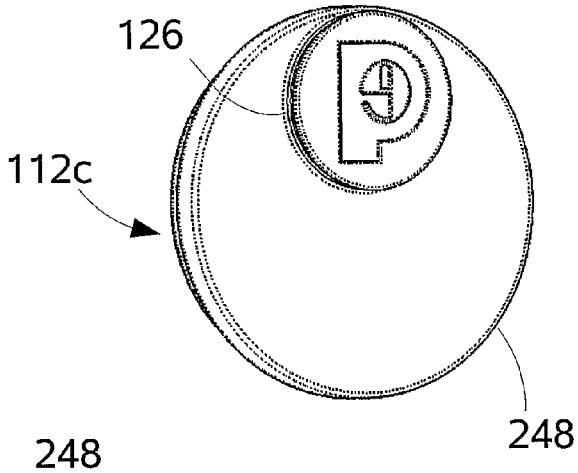
Figure 24B:
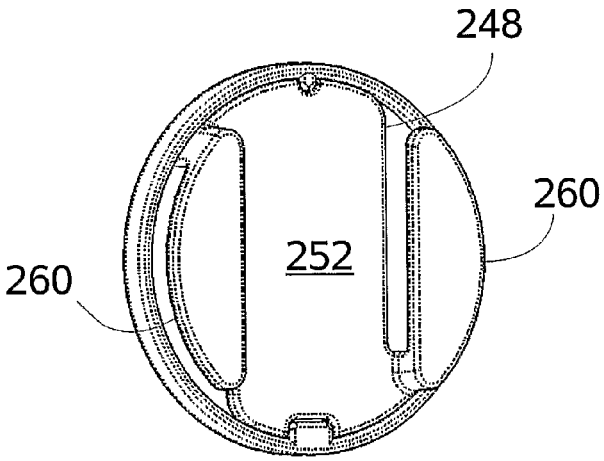
Figure 24C:
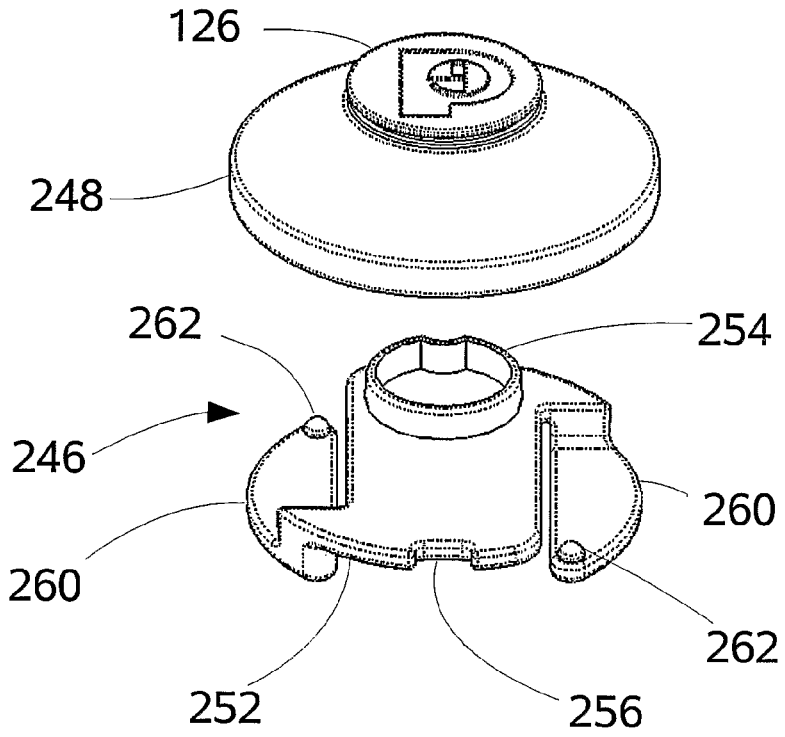
Figure 24D:
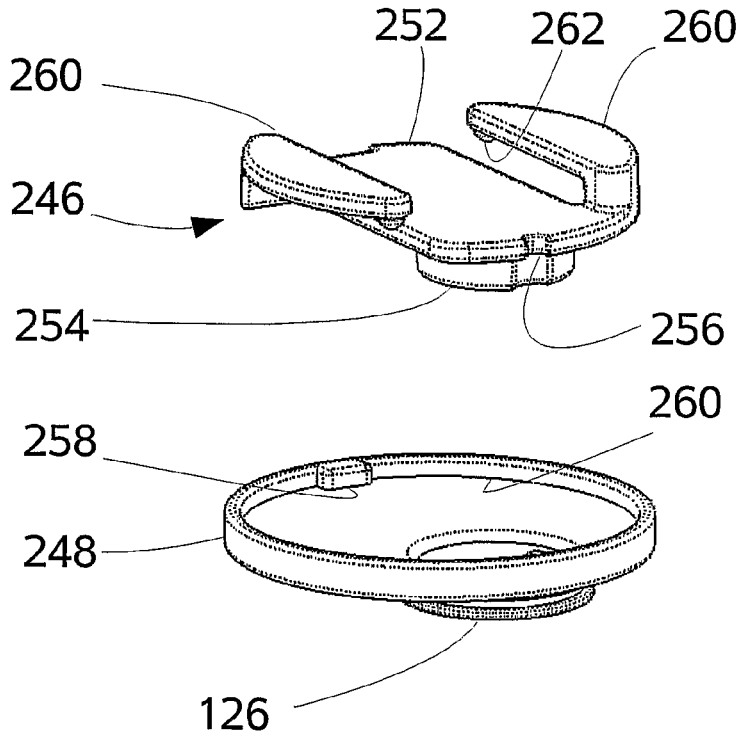
Figure 25:
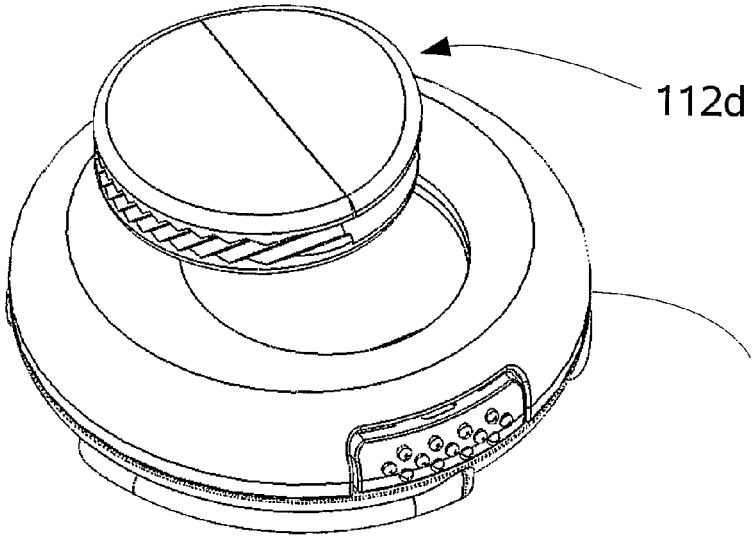
Figure 26A:
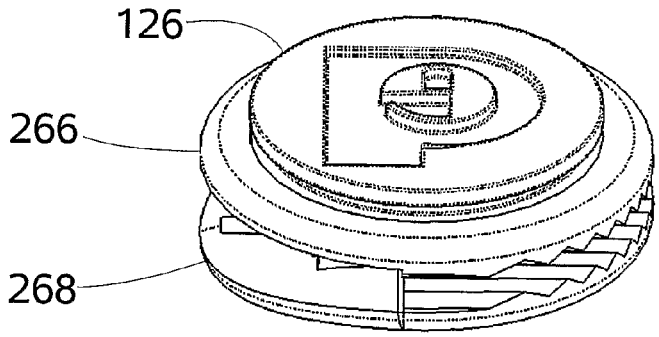
Figure 26B:
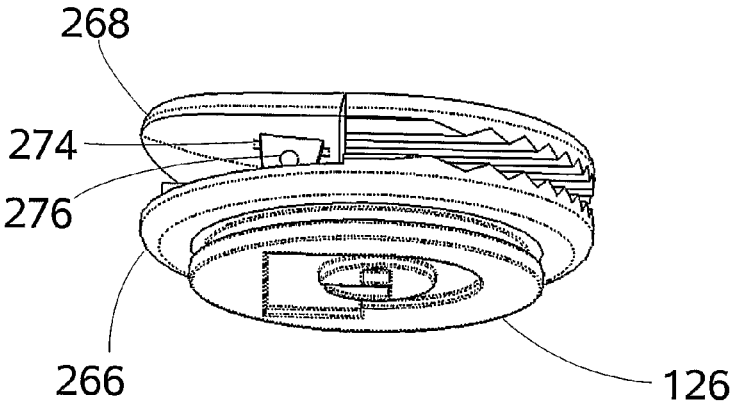
Figure 27A:
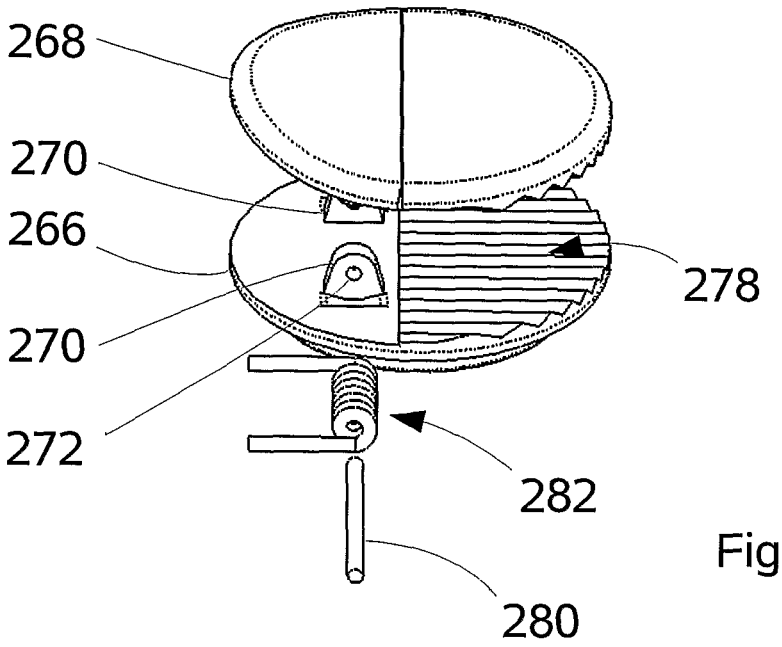
Figure 27B:
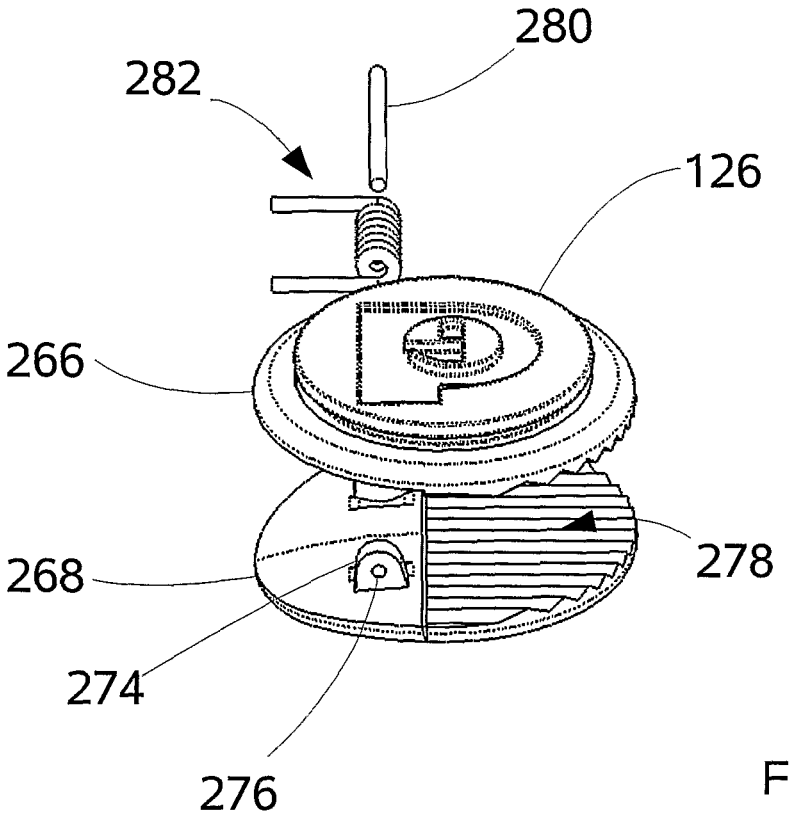
Figure 28:
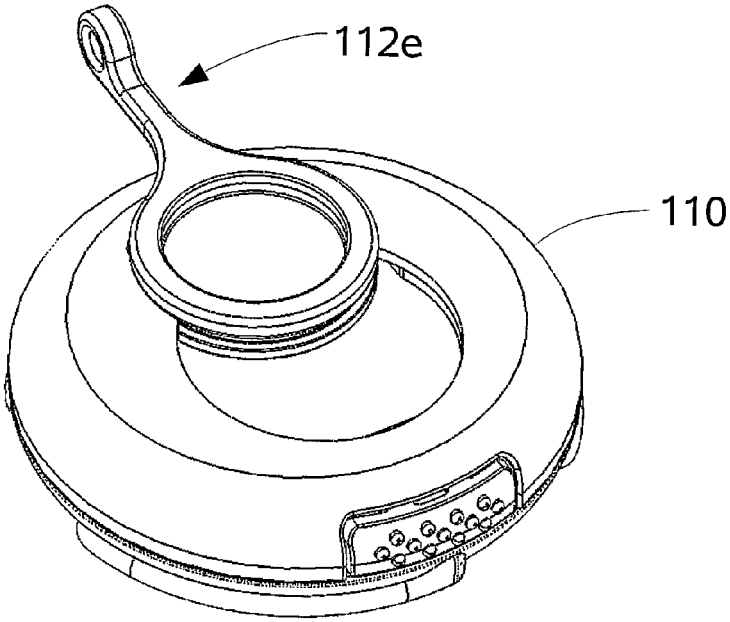
Figure 29B:
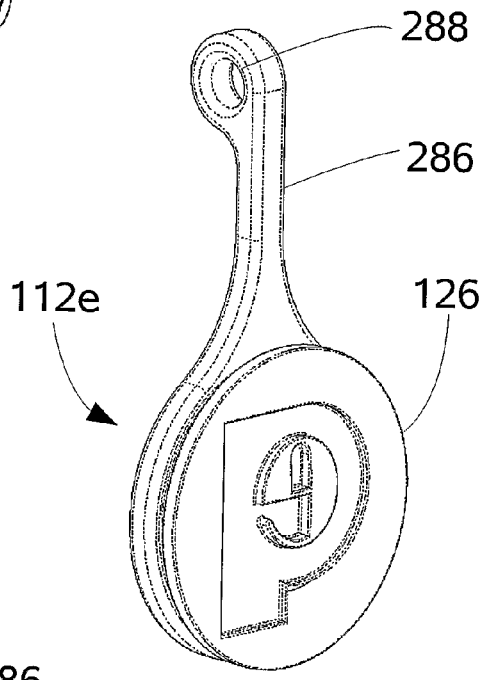
Figure 29A:
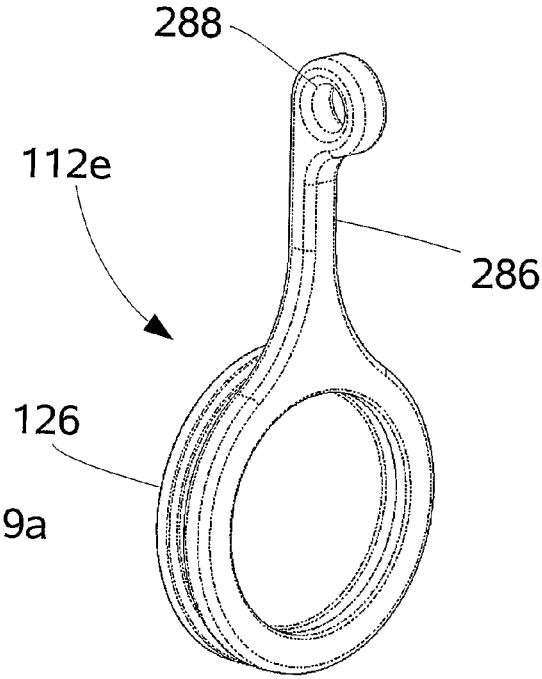
Figure 30:
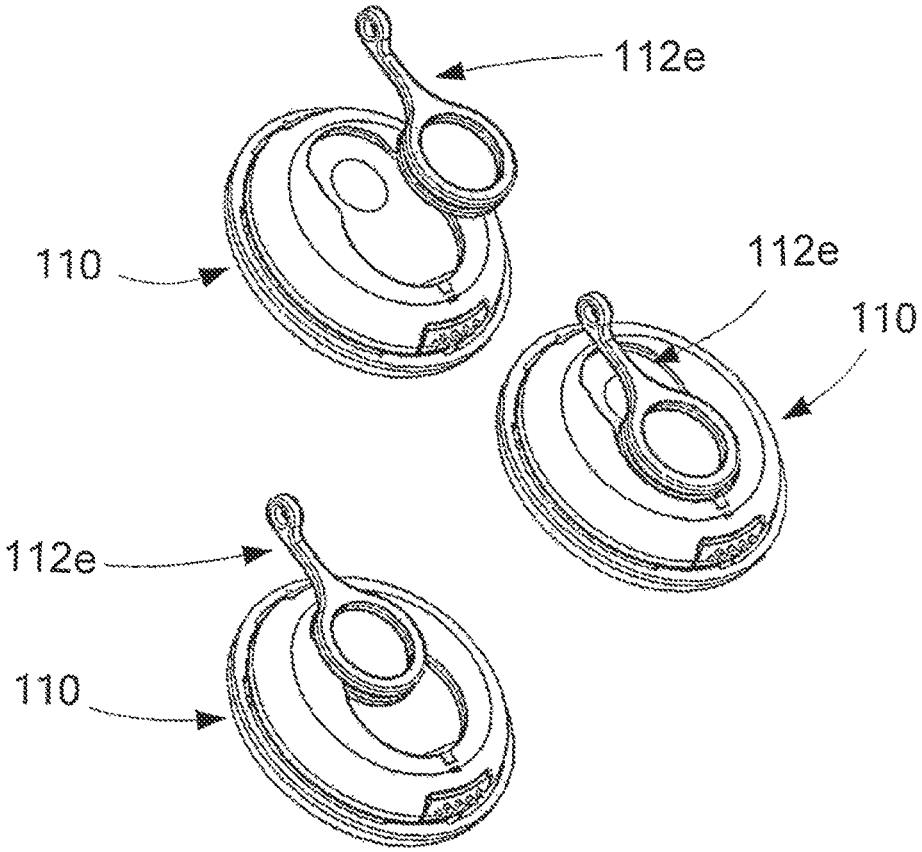
Figure 31:
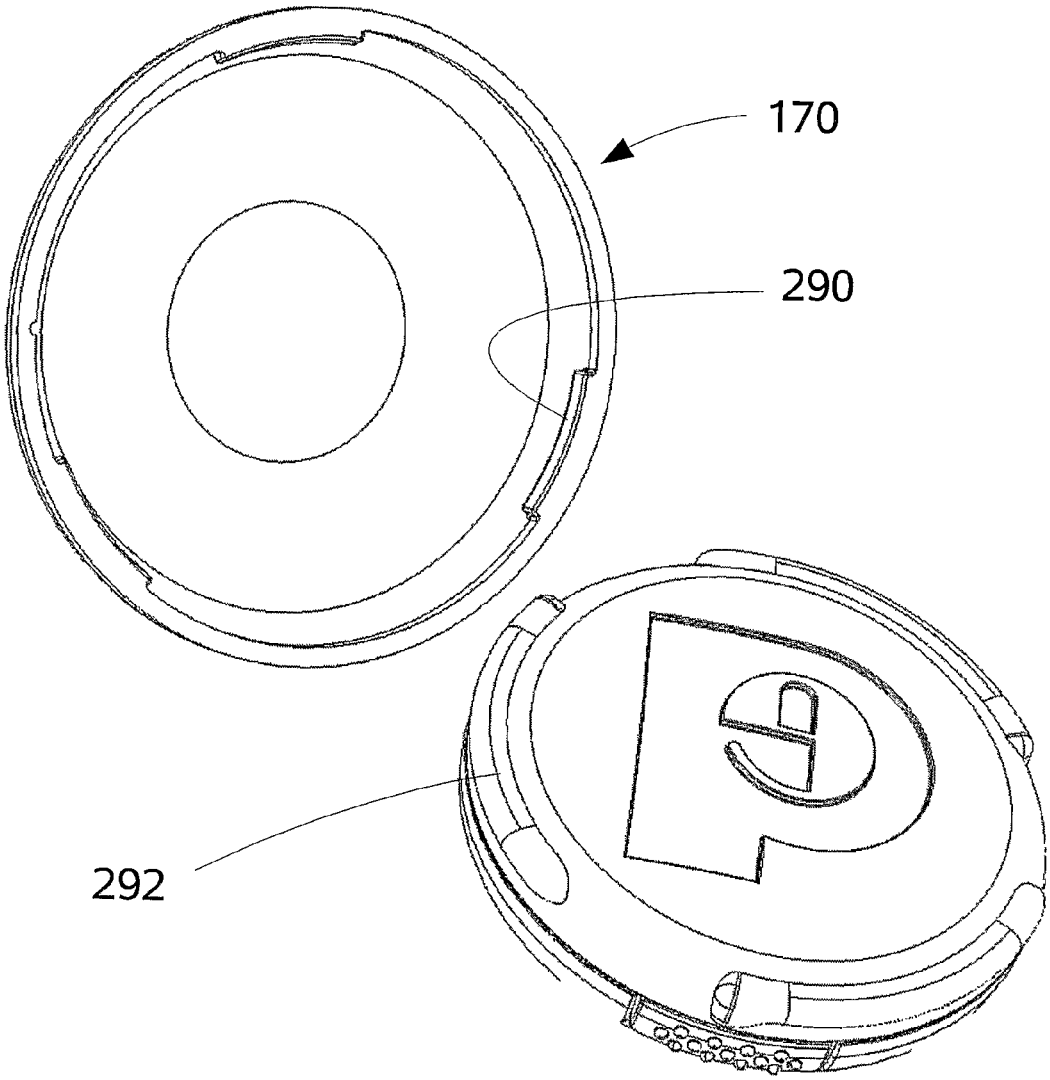

FIGS. 16*a*, 16*b* and 16*c* are assembly, sectional and cutaway views of a tray being a component of the container assembly of the second embodiment;

FIGS. 17*a*, 17*b* and 17*c* are assembly, sectional and cutaway views of an alternative tray being a component of the container assembly of the second embodiment;

FIG. 18 is a detailed cross-sectional view of a catch assembly of the second embodiment;

FIG. 19 shows an embodiment of the invention with a first alternative mounting assembly;

FIGS. 20*a* to 20*d* show the mounting assembly of the embodiment of FIG. 19;

FIG. 21 shows an embodiment of the invention with a second alternative mounting assembly;

FIGS. 22*a* and 22*b* show the mounting assembly of the embodiment of FIG. 21;

FIG. 23 shows an embodiment of the invention with a third alternative mounting assembly;

FIGS. 24*a* to 24*d* show the mounting assembly of the embodiment of FIG. 23;

FIG. 25 shows an embodiment of the invention with a fourth alternative mounting assembly;

FIGS. 26*a* and 26*b* show the mounting assembly of the embodiment of FIG. 25;

FIGS. 27*a* and 27*b* are exploded views of the mounting assembly of the embodiment of FIG. 25;

FIG. 28 shows an embodiment of the invention with a fifth alternative mounting assembly;

FIGS. 29*a* and 29*b* are exploded views of the mounting assembly of the embodiment of FIG. 28;

FIG. 30 shows a sequence of steps in connecting the mounting assembly to the container assembly in the embodiment of FIG. 28; and FIG. 31 is shows means for connecting a face plate to a container assembly.

With reference to the drawings, a first embodiment of the invention takes the form of a cosmetic compact within which a cosmetic preparation such as make-up or sun block can be stored. The receptacle comprises a container assembly 10 and a mounting assembly 12. Note that components of these assemblies are formed as mouldings of plastic material, unless specified otherwise.

With reference now to FIGS. 2 to 5, the mounting assembly 12 includes a backing component 20, which comprises a circular backing disc 22 from which two spaced pins 24 project normally and parallel to one another. Each pin 24 has a pointed end portion remote from the backing disc 22.

The backing component 20 interoperates with a sub-assembly that comprises a front piece 26, a closing plate 28, two pin receivers 30 and a permanent magnet 32. The front piece 26 is generally cylindrical in outer cross-section about a central axis. The pin receivers are formed from resilient material such as rubber of synthetic rubber.

Figure 3:
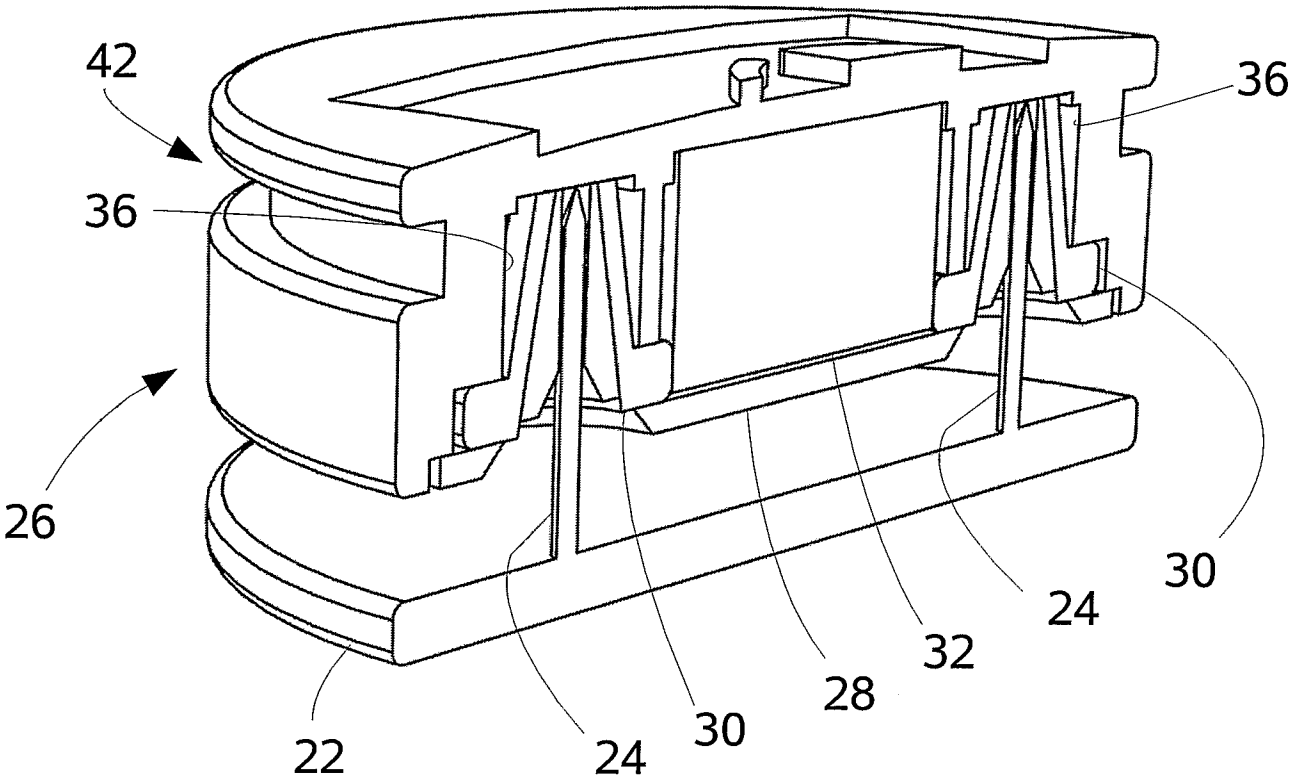
FIG. 3 is a perspective sectional view of the mounting assembly of FIG. 2.
Figure 4:
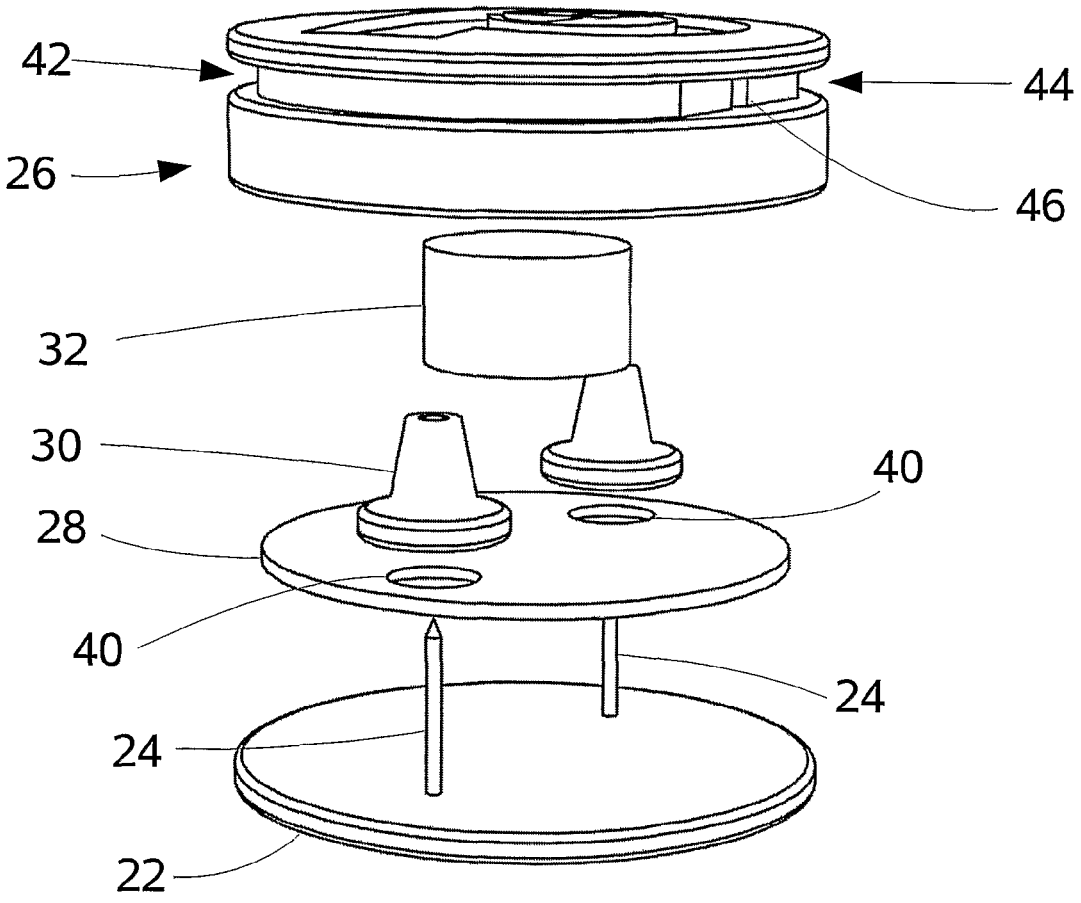
FIG. 4 is an exploded view from above of the mounting assembly of FIG. 2.
Figure 5:
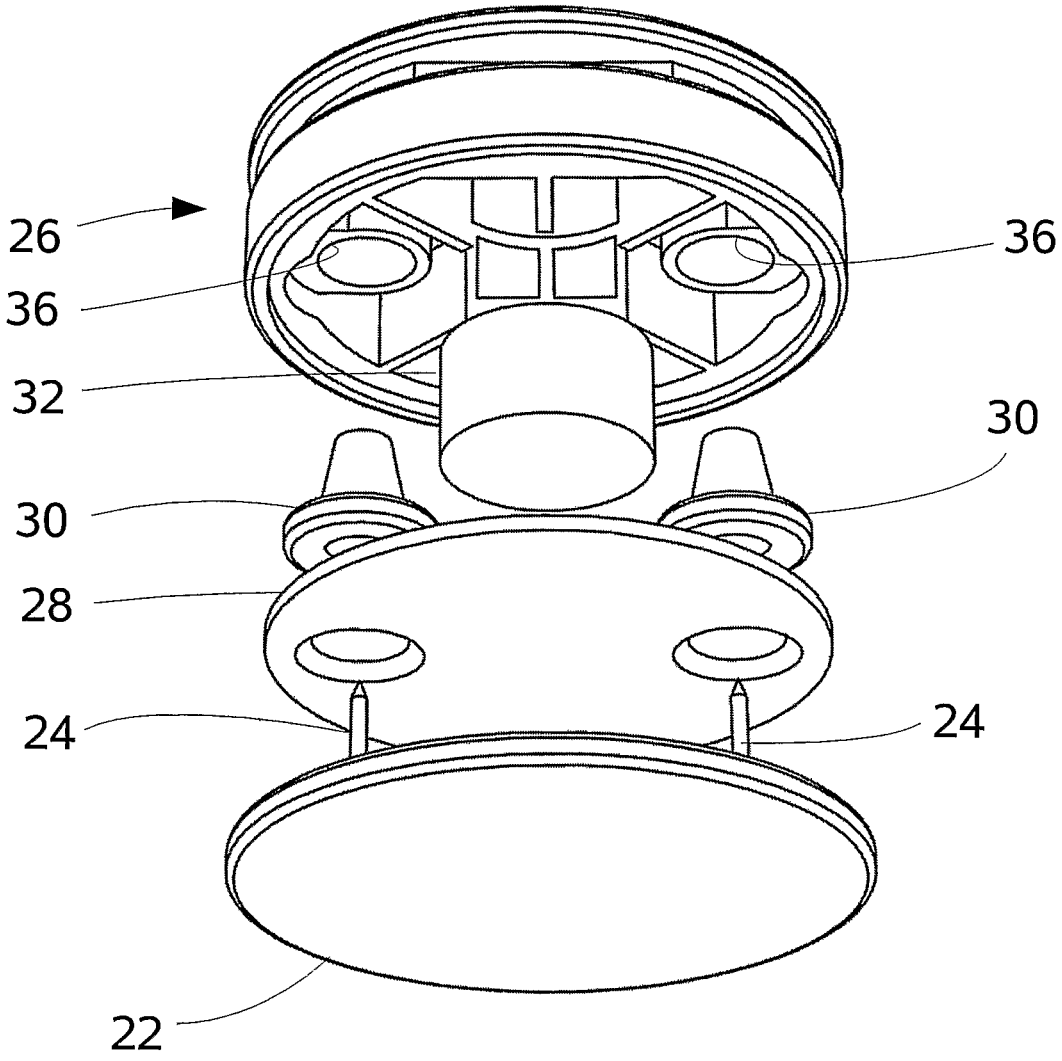
FIG. 5 is an exploded view from below of the mounting assembly of FIG. 2.
Figure 6:
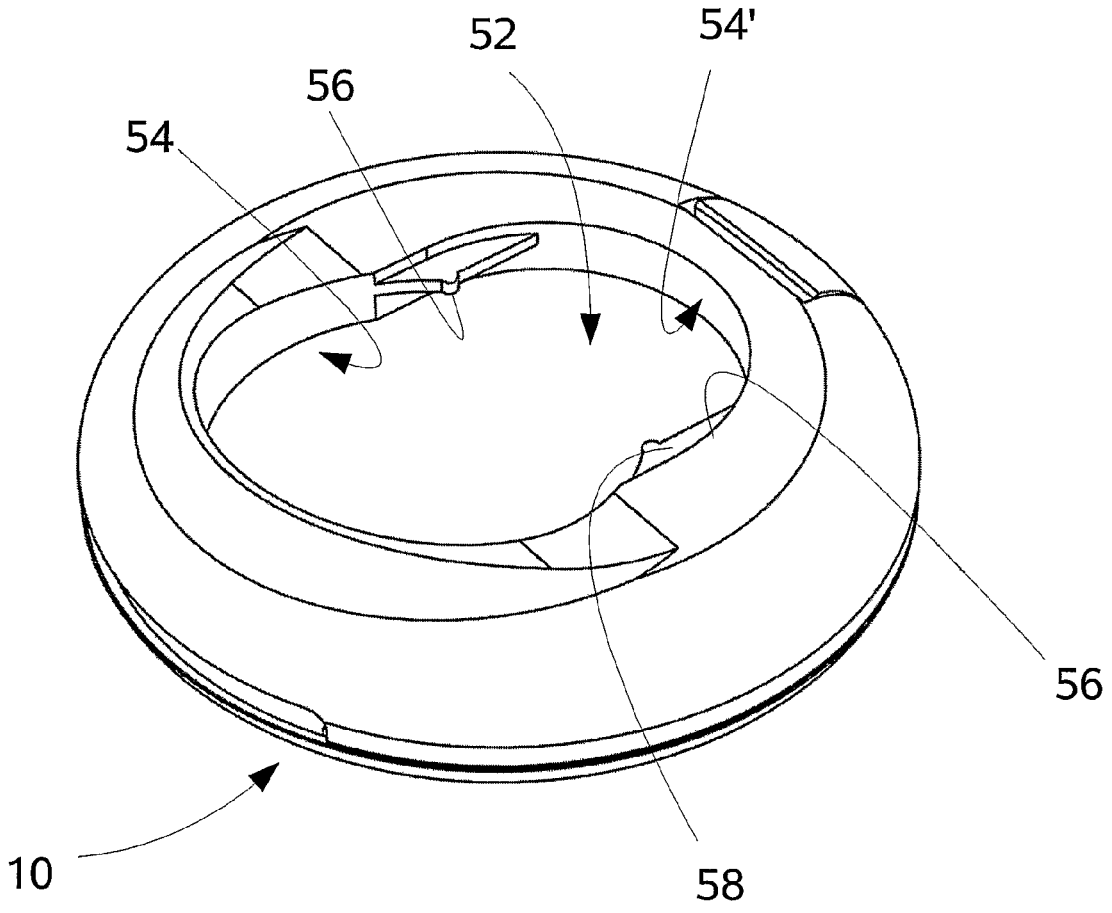
FIG. 6 is a rear perspective view of a container assembly of the embodiment of FIG. 1.

As can be seen from FIG. 3, each the pin receiver 30 comprises a body having a hollow frusto-conical section and a mounting flange. These are shaped and dimensioned so as to be able to receive a respective pin 24 within the hollow frusto-conical section. The section of the pin 24 is larger than that of the hollow interior, so the pin 24 causes the material of the pin receiver to deflect as it is inserted. The result of this is that each pin 24 can be releasably gripped by a respective one of the pin receivers 30.

The frusto-conical section of each pin receiver 30 is retained within a respective void 36 formed within the front piece. The voids 36 extend axially so as to position the pin receivers 30 to receive the pins 24 generally parallel to the axis.

The permanent magnet 32 is shaped as a short cylinder. A further central void 38 within the front piece 26 receives the magnet 32 and retain it coaxially with the front piece.

The closing plate 28 is permanently secured to the front piece 26. It is a generally disc-shaped component with two apertures 40 formed through it. Once in place, the closing plate 28 retains the magnet 32 in place, and traps the mounting flange of each pin receiver 30 to prevent axial movement of it. The apertures 40 are located such that the each pin 24 can pass through a respective one of them to enter a respective pin receiver 30.

A groove 42 is formed into the cylindrical outer surface of the front piece 26. The groove, which extends radially inwardly, has, for the most part, a square cross-section. Diametrically opposed regions of the groove 42 (indicated at 44) are deepened such that in those regions 44, the floor of the groove is generally flat, with a central indentation 46.

An axial outer surface of the front piece 26 carries decorative indicia.

The container assembly has an outer part 50 which is adapted to contain specific preparations or articles. This will be described later. The container also comprises a coupling region on its inner surface, shown generally at 52.

The coupling region 52 comprises a recess in an inner wall of the container assembly 10. A first region of the recess has an outer wall 54 that is shaped as a segment of a circle having a diameter slightly greater than the outer diameter of the front piece 26. A second region of the recess has an outer wall 54' that is shaped as a segment of a circle having a diameter slightly greater than curved region of the floor of the groove 42.

Close to an interface between the first and second regions 54,54', a pair of fins 56 project towards one another into the void in a plane parallel to a base of the recess. Each fin 56 carries a locking projection 58 that projects radially innermost.

Assembly and use of the receptacle will now be described.

First, the mounting assembly 12 is mounted onto the fabric of a garment. This is achieved by separating the backing component 20 from the subassembly. The pins 24 are then passed through the fabric (this being eased by the pointed ends) and the mounting assembly is re-assembled by passing the pins 24 through the apertures 40 into the pin receivers. The fabric is then trapped between the backing disc and the closing plate 28, whereby the mounting assembly 12 is secured to the fabric. It should be noted that the pins 24 are retained by a frictional push fit only, as contrasted with a positive locking fit. Under normal conditions, this is sufficient to retain the container assembly in place. However, if it is subjected to an unexpectedly high load, the connection will part. This reduces the chance that damage will occur to a garment if the container assembly gets caught or is subject to impact.

Figure 7:
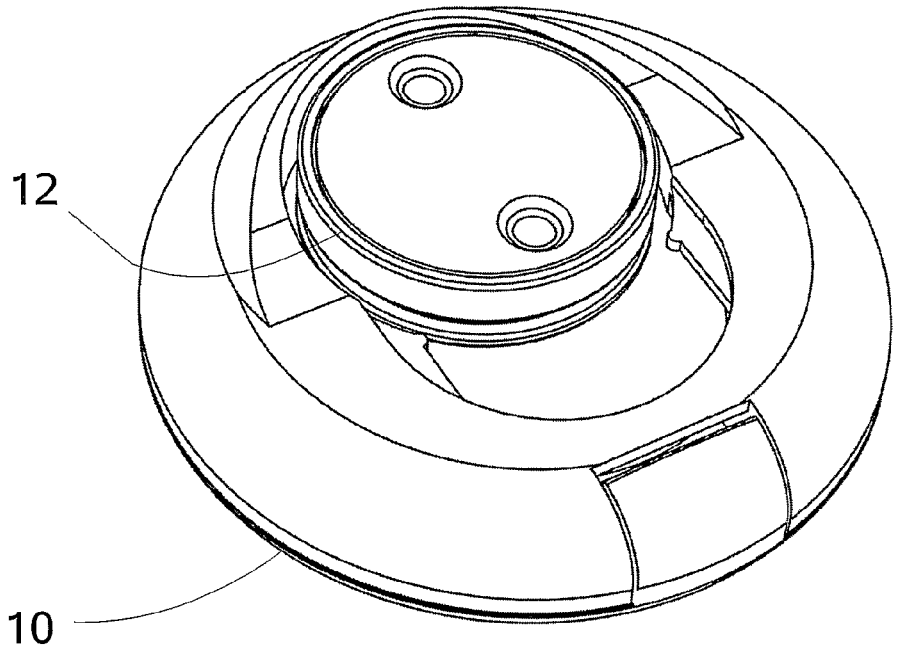
FIGS. 7 and 8 show a sequence of interconnection between the container assembly and the mounting assembly of the embodiment of FIG. 1.
Figure 8:
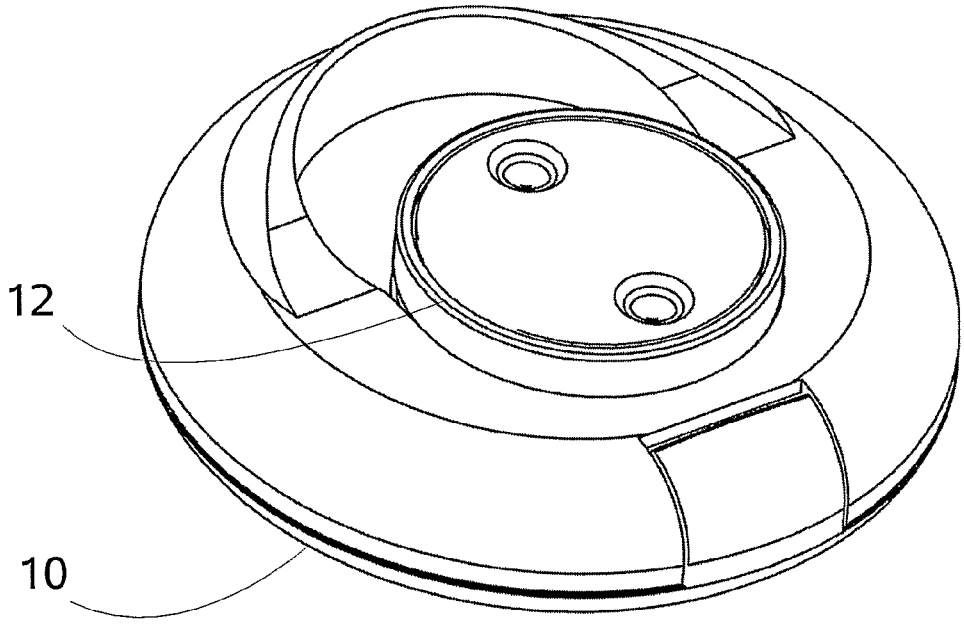

The container assembly 10 is then mounted on the mounting assembly 12. The front piece 26 is introduced into the void 54 at its portion of larger diameter (shown in FIG. 7). The front piece 26 is then displaced radially with respect to the mounting assembly 12. The fins 56 enter the groove 42. If necessary, the container assembly 10 is rotated such that the fins 56 enter the deepened regions 44 of the groove 42 (shown in FIG. 8). The each locking projection 58 enters a respective central indentation 46, the dimensions of the groove 42 and the fins 56, causing the fins 56 to undergo resilient deformation so that the projections 58 snap into place thereby retaining the components interconnected to one another. Separation of the container assembly 10 from the mounting assembly 12 is achieved by displacing them in the opposite direction. This steps in procedure are illustrated in FIG. 30.

Figure 9:
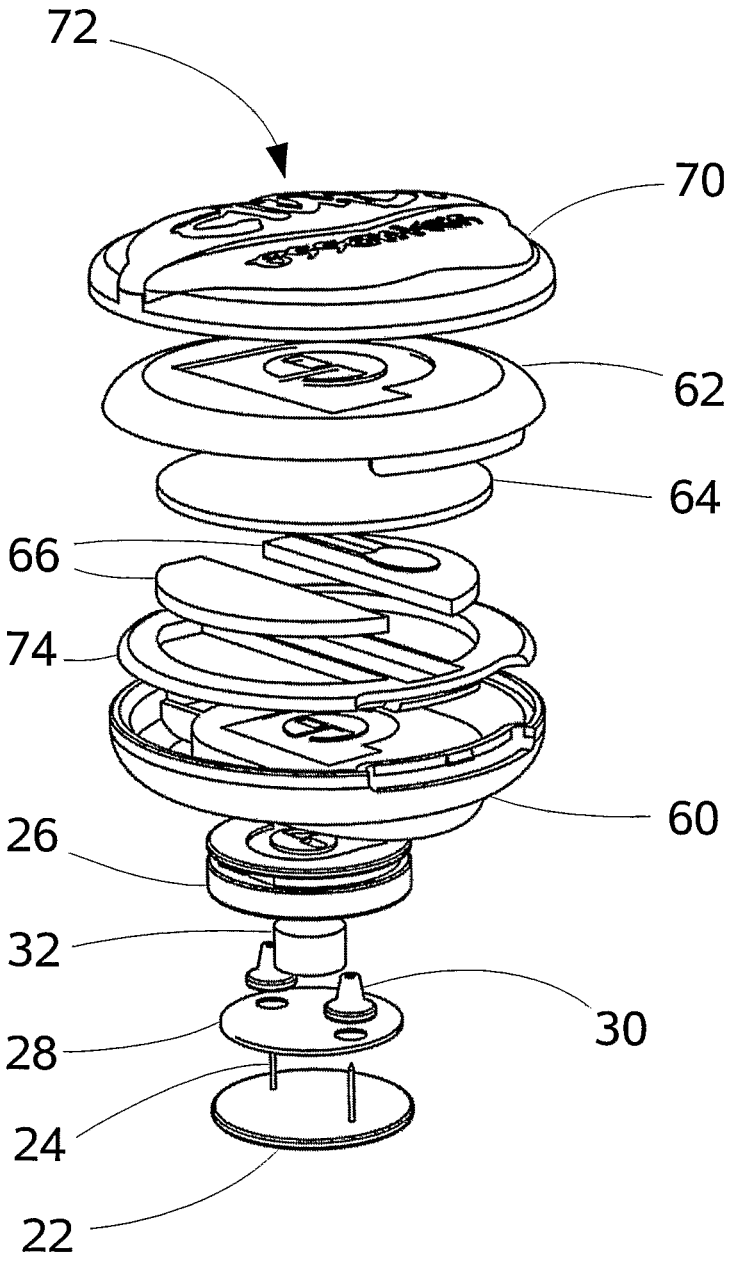
FIGS. 9 and 10 are exploded views of the embodiment of FIG. 1.
Figure 10:
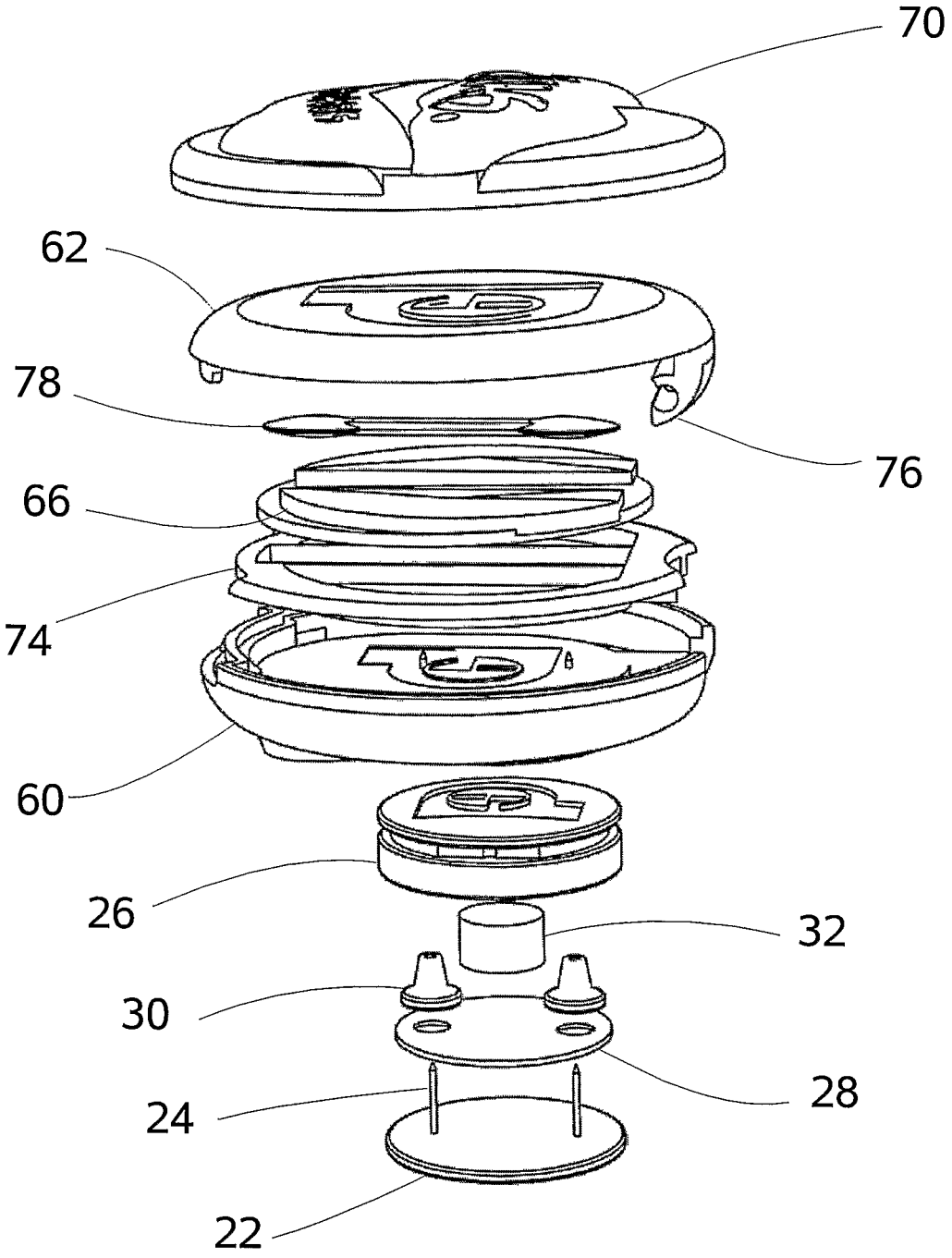
Figure 11:
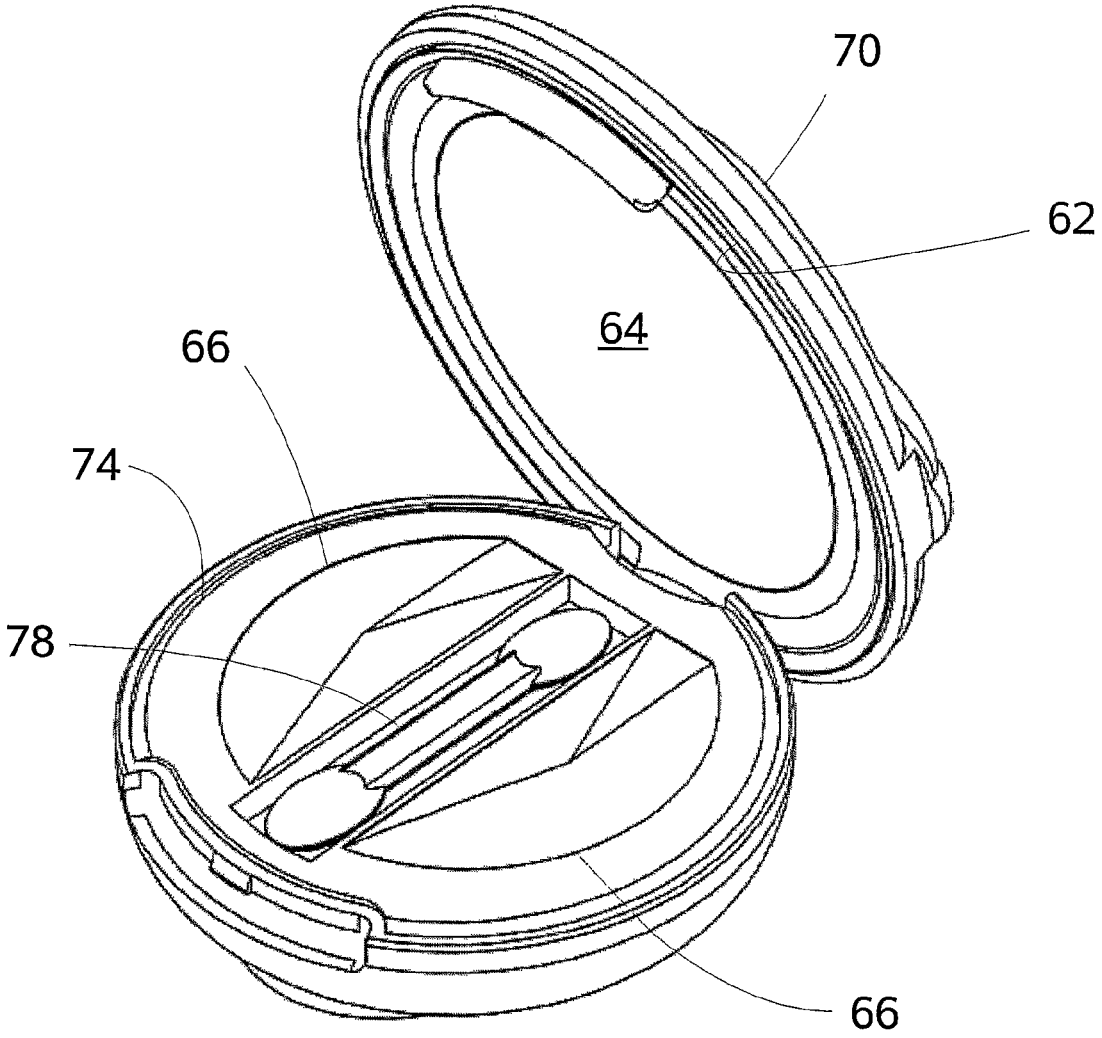
FIG. 11 shows the complete container assembly in an open condition.
Figure 12:
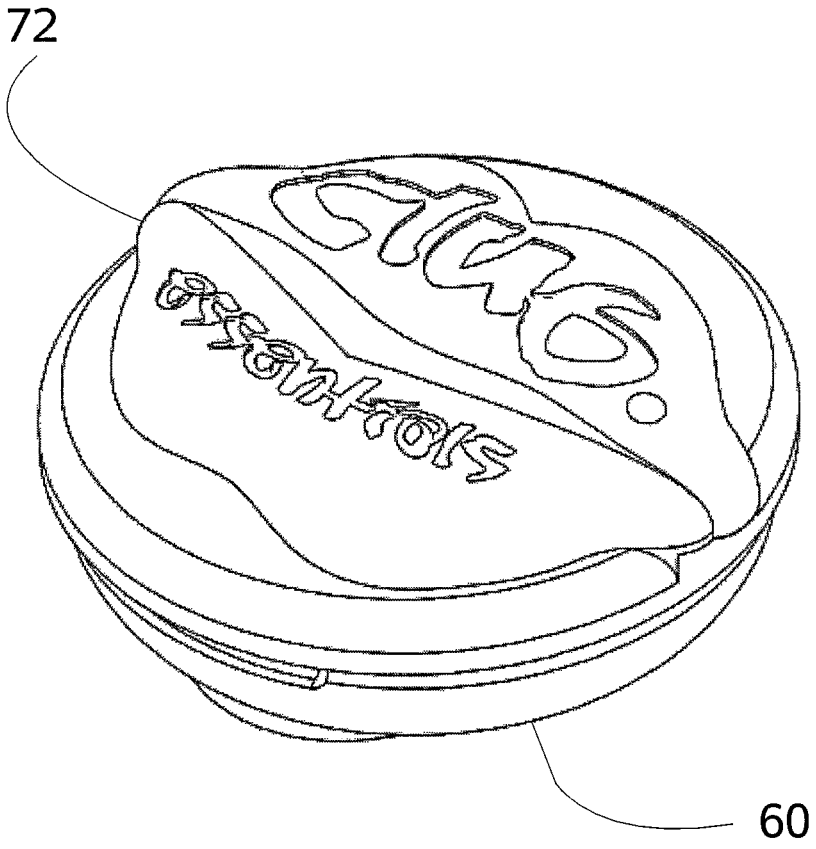
FIG. 12 shows the complete container assembly in a closed condition.

The components of the container assembly 10 can be seen in FIG. 9. These comprise a base 60 connected to a hinged lid 62. The base 60 and lid 62 are interconnected by an internal in-moulded hinge assembly. The hinge is hidden internally, making it aesthetically pleasing.

Figure 1:
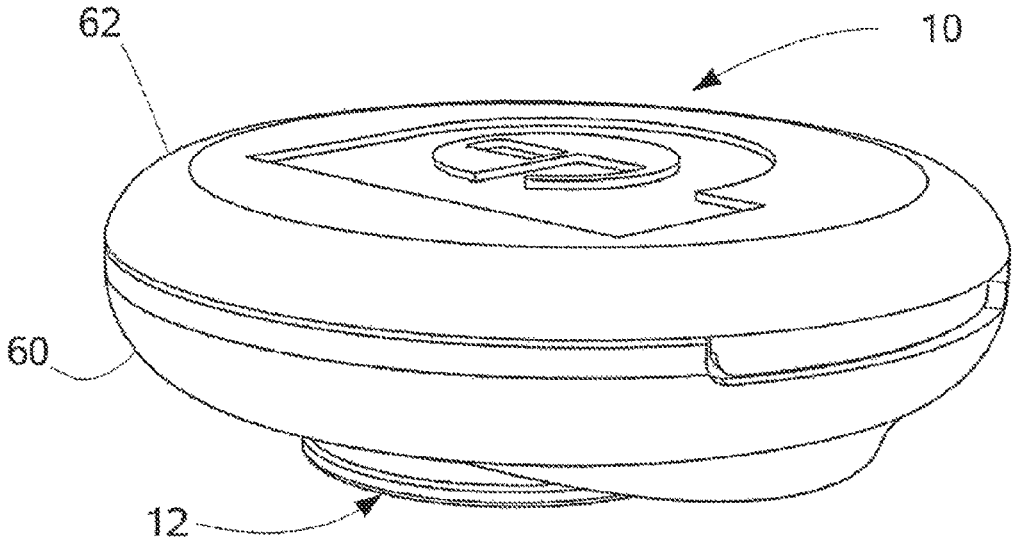
FIG. 1 is a perspective view of a detachable receptacle being a first embodiment of the invention.
Figure 2:
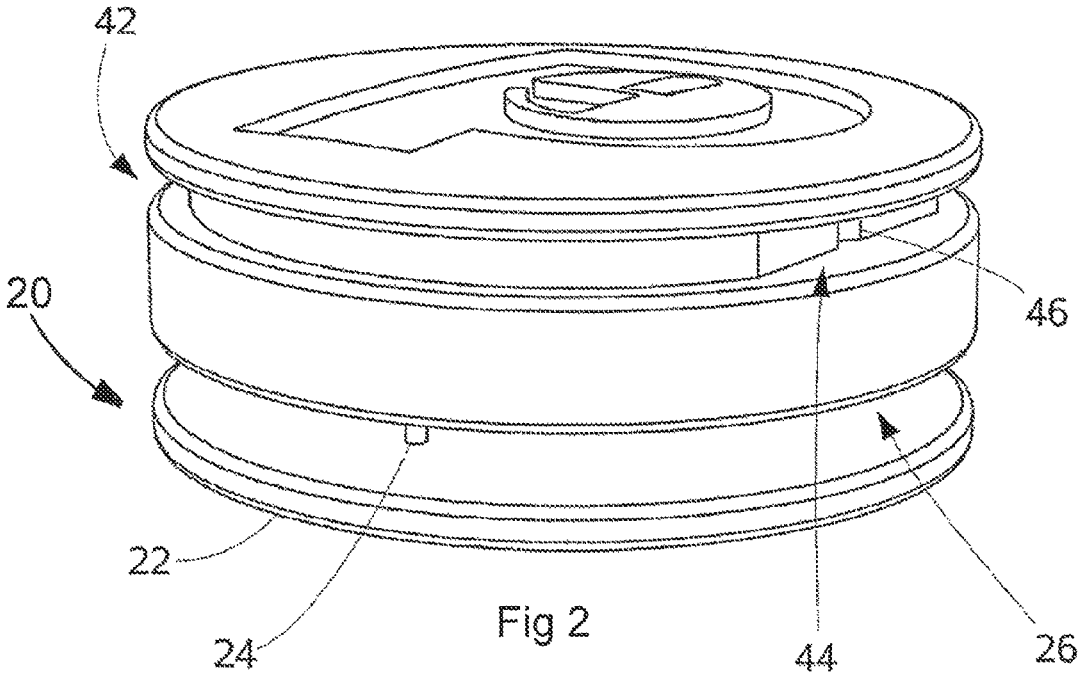
FIG. 2 is a perspective view of a mounting assembly of the embodiment of FIG. 1.

In this embodiment, the contents include a mirror 64 carried within the lid 62. Additionally, the contents may include blocks of solid cosmetic composition 66 and application implements 78 contained within a tray 74 that is retained within the base 60 as a frictional push fit. The tray may be include a ferromagnetic component that is attracted to the magnet 32 to enhance its retention. The hinged lid 62 can be moved to a closed position, as illustrated in FIG. 1, in which there is a watertight enclosure formed in a space between the base 60 and the lid 62.

Upon release of a catch 68, the lid 62 can be pivoted to an open position, in which items within the enclosure can be accessed. If the lid 62 is moved past the open position, a projection 76 of it engages with the tray 74 to eject it from the base 60. The container assembly can be refilled when its contents are exhausted by ejecting the tray 74 and replacing it with a new, full one. To further enhance the ability to brand a container assembly, the tray 74 and the base 60 can be provided with interengaging formations that are unique to each brand. These formations can prevent the tray 74 of one brand being introduced into the base 60 of another brand. To ensure that the watertight properties of the container assembly remain effective, seals, for example of rubber, are in-moulded on to an outer rim of the tray 74, so that each time a new refill is added, the seal of the container is renewed.

It will be seen that the container assembly can be readily adapted to hold other things, for example, articles such as keys or coins, or compositions such as sun block.

The container assembly can advantageously further include a face plate 70. The face plate 70 is attached to and covers the hinged lid 62. The main purpose of the face plate 70 is to enable the container assembly to be customised. Indicia, such as a corporate logo or trade mark 72 can be applied to an outer surface of the face plate 70. Since it is the face plate 70 that is most clearly visible when the container assembly is in use, effective customisation of its appearance can be achieved by customisation of the face plate 70. A user may select from a number of plates to allow customisation of the appearance of the container, for example to ensure that its colour or other aspect of its appearance accords with a garment to which the container will be connected.

A second embodiment of the invention will now be described. This embodiment is generally similar to the first embodiment, and the features in common will be described only briefly. Where a feature of the second embodiment corresponds with one of the first, it will be given a reference numeral equal to that given to the feature of the first embodiment with 100 added to it. Where a feature of the second embodiment has no corresponding feature in the first embodiment, it will be given a reference number of 200 or more.

Figure 13:
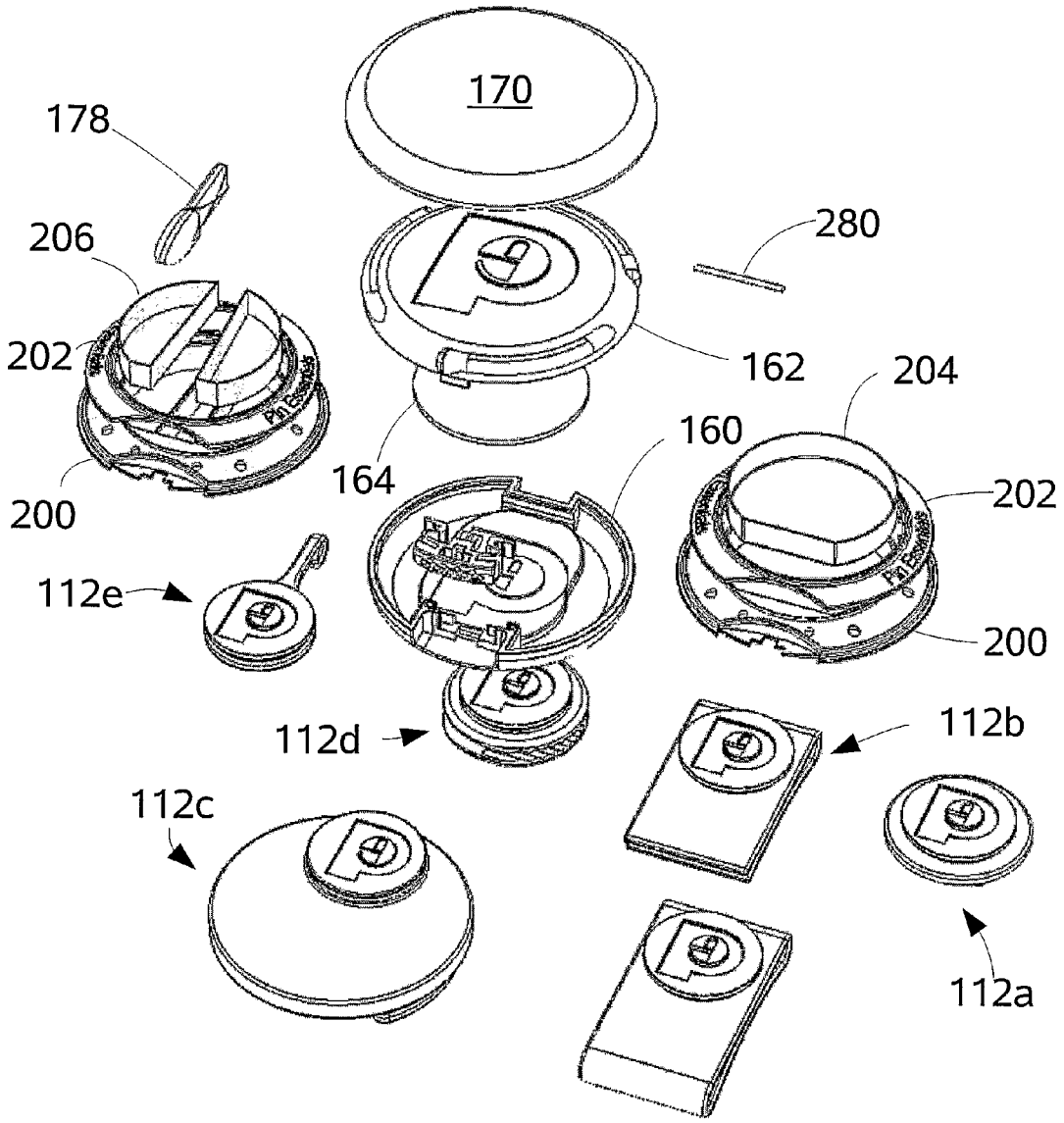
FIG. 13 is an exploded view of a second embodiment of the invention.
Figure 14:
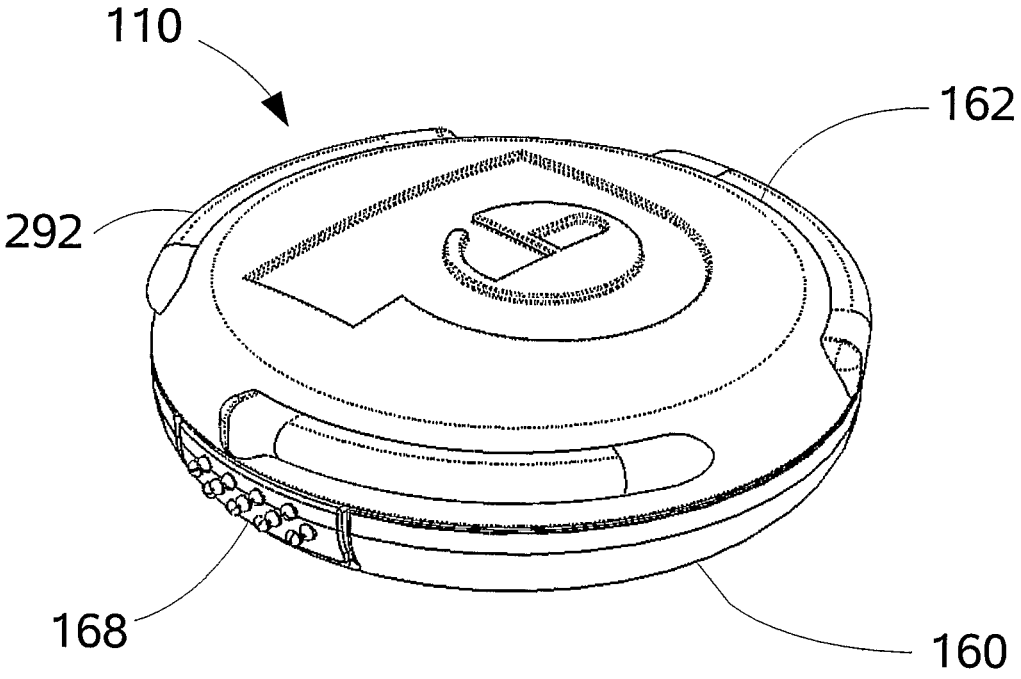
FIGS. 14 and 15 are top and bottom external views of a container assembly of the second embodiment.
Figure 15:
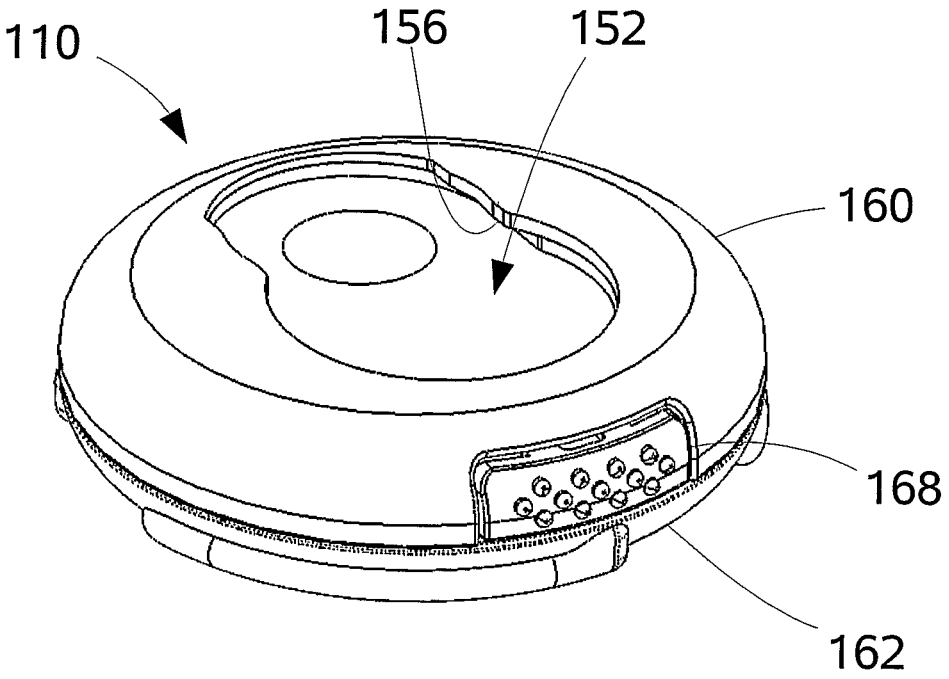

With reference to FIG. 13 onward, the second embodiment comprises a container assembly 110. Two alternative container assemblies are shown in FIG. 13; these have identical external appearance, as shown in FIGS. 14 and 15.

A first embodiment of the container assembly 110 includes a tray 174 that is shown in FIGS. 16*a* to 16*c*. This tray 174 provides a single space for a single cosmetic composition.

The tray 174 is an assembly of three main components: a carrier 200, a seal 202 and an insert 204. The insert 204 is a moulded plastic open-topped container within which a block of cosmetic material can be formed. The carrier 200 has a recess within which the insert 204 is a close fit. The carrier has a peripheral upper surface upon which the seal 202 is carried such that the hinged lid 162 can form a seal against it. The seal, as shown, is a separate moulding of resilient material that is connected to the carrier. However, it may alternatively be co-moulded or overmoulded with the carrier 200.

The alternative tray 174 shown in FIGS. 17*a* to 17*c* comprises a similar carrier 200 and seal 202. The tray 174 includes two carriers 206, 206' that fit within the recess with a narrow rectangular space between adjacent parallel walls. The space can be used to receive an article such as a small application implement.

The tray is received within the base 160, as in the first embodiment.

In this embodiment, the catch 168 serves two purposes, as will be described with reference to FIG. 18. As with the first embodiment, it serves to retain the lid 162. A hook-shaped formation 210 of the lid 162 is retained below a step formation 212 of the catch 168. Depression of the catch 168 into the base 160 by a short distance releases the hook-shaped formation 210 and allows the lid 162 to be hinged away from the base 160.

An end portion of the catch 168 is wedge-shaped, as shown at 216. Upon further depression of the catch, the end portion of the catch 216 makes contact with the carrier 200. The wedge shape of the catch causes the carrier 216 to be ejected from the base 160.

The container assembly 10, 110 can be mounted upon any mounting assembly that can interconnect with the coupling region 52, 152. This allows for a number of alternative mounting assemblies to be provided for use with a common container assembly 10, 110. The alternative mounting assemblies allow the receptacle to be attached to a wide range of articles of clothing, including those for which the perforations as caused by use of the embodiment illustrated in FIG. 4 would not be acceptable.

The face plate 170, in this embodiment, has peripheral lugs 290. These interengage with locating formations 292 on the lid 162. This allows the face plate 170 to be connected to the lid 162 and disconnected from the lid by a twisting bayonet-like action.

FIG. 19 shows a first of these alternatives. As can be seen from FIG. 20*a*-20*c*, the mounting assembly 112*a* includes a front piece 126 that can be received within the coupling region 152 of the container assembly 110. The front piece 126 is carried on a disc-shaped plate portion 220. The plate portion 220 carries a disc-shaped connector 222 within a recess 224 in a surface opposite the coupling region 152.

The connector 222 carries a metal pin 224. The pin 224 is shaped as a segment of a circle of radius of which is slightly less than the radius of the connector 222. A first end portion 226 of the pin is pointed to enable it to be passed easily through fabric material. An opposite end portion 228 is looped back upon itself. The section of the pin adjacent to the opposite end portion 228 is received within a U-shaped hoop 230 formed in the connector 222 such that it can be pivoted with respect to the connector 222. The pointed end portion 226 can be received beneath a hook-like formation 232 that projects from the connector, but is sufficiently flexible that it can be pulled radially inwardly of the connector 222 to allow it to be pivoted past the hook-like formation 232.

For use, the pin is pivoted away from the connector 222 so that its pointed end portion 226 can be passed twice through a piece of fabric. The pin is pivoted back towards the connector 222 and passed under the hook-like formation 232. This prevents removal of the mounting assembly 112*a* from the fabric and also shields the pointed end portion 226.

An embodiment having a further alternative mounting assembly 112*b* is shown in FIG. 21. The mounting assembly 112*b*, shown in FIGS. 22*a* and 22*b*, is in the form of a clip that can be placed over a part of a garment such as a belt. The clip is formed as a strip of plastic material formed into a U-shape. The strip has a flat side 240 and a curved side 242. The front piece 126 is formed on the flat side 240. The curve of the curved side provides a tapered lead-in that assist in its placement on a garment.

The further embodiment shown in FIG. 23 is also suitable for mounting on a belt or a similar article. The mounting assembly 112*c* is shown in FIGS. 24*a* to 24*d*. The mounting assembly comprises inner and outer components 246, 248. The outer component 248 is generally disc-shaped with an outer diameter that is close to the diameter of the container assembly 10, 110 to which it is intended to be connected. A recess 250 of circular periphery is formed into a first surface of the outer component 248. The front piece 126 is formed on the opposite surface such that it projects from it. In this embodiment, the front piece 126 is disposed towards the periphery of the outer component 248; it may alternatively be central.

The inner component has a central region 252 that can fit closely within the recess 250. The central region 252 is shaped as a rectangle with rounded ends and parallel, straight sides. To assist in its retention within the recess 250, the central region has a projection 254 that fits closely within a recess that is formed opposite the front piece 126. Interengaging formations 256, 258 in the central region 252 and the periphery of the recess 250 prevent mutual rotation of the inner and outer components 246, 248.

A pair of arms 260 extend from regions close to opposite ends and opposite sides of the central region 252 in a plane that is spaced from the central region 252 away from the outer component 248. The arms 260 have inner edges that are approximately parallel to the straight edges of the central region 252, and outer edges that approximately overlie the periphery of the outer component 248. Remote from their connection to the central region 252, each arm has a small projection 262 that extends towards the plane of the central region.

To connect the mounting assembly 112*c* to a belt, it is placed such that the belt extends between the arms 260 and one side of the belt is in contact with the central region 252. The mounting assembly 112*c* is then twisted, such that the arms pass to the other side of the belt, where the projections serve to retain it. The container assembly 110 can then be releasably connected to the front piece 126, as with other embodiments.

With reference now to FIG. 25, a yet further embodiment has a mounting assembly 112*c* that is in the form of a spring clip that can be attached to an edge region of a piece of fabric.

The mounting assembly 112*d* has first and second components 266, 268. Each of these has a circular periphery that is of diameter approximately half that of the container assembly 110. The first component 266 carries the front piece 126 on one of its sides. On the opposite side of the first component 266, there are two projecting lugs 270. A bore 272 extends through each of the lugs 270, the bores being coaxial.

The second component 268 also has two projecting lugs 274 on one of its sides. The lugs 274 have coaxial bores 276. The lugs 274 of the second component 268 are spaced such that their mutually proximal faces fit closely adjacent the opposite faces of the lugs 270 of the first component 266. The bores 276 of the second component 268 are smaller in diameter than the bores of the first component 266.

Both the first and second components 266, 268 have textured regions 278 extending from the lugs to the periphery of the components. In this embodiment, the textured regions 278 have a plurality of parallel ribs.

The mounting assembly 112*d* further comprises a steel pivot pin 280 and a spring 282. The pin 280 is a cylinder of diameter that makes it a close interference fit in the bores 276 or the second component 268 and a pivotal fit in the bores of the first component 266. The spring 282 has a coiled region of length that allows it to fit closely between the lugs 270 of the first component 266 and of diameter that allows the pin 280 to slide within in. Arms project radially from ends of the coiled region.

To assemble the mounting assembly 112*d*, the first and second components 266, 268 are brought together such that their bores 272, 276 are aligned and their textured regions 278 face one another. The spring 282 is introduced between the first and second components 266, 268 with its coiled region in alignment with the bores 272, 276 and the arms extending away from the textured regions 278. The pin 280 is then driven into the bores 272, 276. This allows the components to pivot with respect to one another. The spring 282 urges the textured regions 278 into contact with one another.

Grasping the mounting assembly 112*d* remote from the textured regions 276 and squeezing the components together causes the first component 266 to pivot about the pin 280 with respect the second component 268 against the action of the spring 282. A piece of fabric introduced between the textured regions 278 will then be gripped upon release of the components under the action of the spring 282. The container assembly 110 can then be releasably connected to the front piece 126, as with other embodiments.

With reference now to FIG. 28, a yet further embodiment has a mounting assembly 112*e* that can be secured to a pendant, ribbon, string or a similar elongate element.

The mounting assembly 112*e* is a one-piece moulding in this embodiment. The moulding includes the front piece 126 from which a stalk 286 projects. A loop 288 is formed in the stalk 286. The mounting assembly can be connected to a garment or a pendant by passing a suitably strong element through the loop 288.

The three views of FIG. 30 show interconnections of the mounting assembly 112*e* of the last embodiment to the container assembly 110. The sequence of connection progresses downwardly in FIG. 30.

The components of these embodiments are all shown in FIG. 13.

An embodiment may include a set comprising a container assembly 110 and one or more of the connection assemblies described above.

The invention claimed is:

1. A receptacle for a cosmetic composition comprising:

a) a container assembly including:

a closable container;

a removable tray located inside the closable container, the removable tray including an outer rim, the removable tray includes a ferromagnetic material, the removable tray is adapted to retain a cosmetic composition;

a rubber seal located on the outer rim of the removable tray to create a watertight seal on the closable container in a closed position;

a retention device for retaining the tray within the container assembly;

a release device operatively connected to the retention device to release the removable tray from the container;

b) a mounting sub-assembly, the mounting sub-assembly is independent from the container assembly, the mounting sub-assembly including:

a backing device to enable the mounting sub-assembly to be releasably connected to a first side of a piece of fabric material, the backing device including a base, two spaced apart pins;

a sub-assembly adapted to connect to a second side of the piece of fabric material, the sub-assembly operatively connected to the backing device, the sub-assembly including:

a front piece having two side cavities and a central cavity;

a closing plate including two holes, two pin receivers made of a resilient material, each pin receiver is aligned with a corresponding hole on the closing plate, the pin receiver is retained on the corresponding side cavity of the front piece;

a magnet located between the front piece and the closing plate, the magnet retained on the central cavity of the front piece;

each pin is adapted to pass from the first side of the piece of fabric to the second side of the piece of fabric, through a corresponding hole on the closing plate and then through the corresponding pin receiver;

the front piece is operatively connected to the container assembly;

a connection device to releasably connect or release the mounting sub-assembly from the container assembly:

1) while the backing device remains connected to the piece of fabric material; and 2) with the container assembly in the closed position.

2. The receptacle according to claim 1, further comprising a face plate removably connected to the closable container.

3. The receptacle according to claim 2, wherein the face plate includes a visible indicia.

4. A receptacle for a cosmetic composition consisting of:

a) a container assembly including:

a closable container;

a removable tray located inside the closable container, the removable tray including an outer rim, the removable tray includes a ferromagnetic material, the removable tray is adapted to retain a cosmetic composition;

a rubber seal located on the outer rim of the removable tray to create a watertight seal on the container in a closed position;

a retention device for retaining the tray within the container assembly;

a release device operatively connected to the retention device to release the removable tray from the container;

b) a mounting sub-assembly, the mounting sub-assembly including:

a backing device to enable the mounting sub-assembly to be releasably connected to a first side of a piece of fabric material, the backing device including a base, two spaced apart pins;

a sub-assembly adapted to connect to a second side of the piece of fabric material, the sub-assembly operatively connected to the backing device, the sub-assembly including:

a front piece having two side cavities and a central cavity;

a closing plate including two holes, two pin receivers made of a resilient material, each pin receiver is aligned with a corresponding hole on the closing plate, the pin receiver is retained on the corresponding side cavity of the front piece;

a magnet located between the front piece and the closing plate, the magnet retained on the central cavity of the front piece;

each pin is adapted to pass from the first side of the piece of fabric to the second side of the piece of fabric, through a corresponding hole on the closing plate and then through the corresponding pin receiver;

the front piece is operatively connected to the container assembly;

a connection device to releasably connect or release the mounting sub-assembly from the closable container assembly:

1) while the backing device remains connected to the piece of fabric material; and 2) with the container assembly in the closed position.

* * * * *